US005949393A

United States Patent [19]

Sakai et al.

[11] Patent Number: 5,949,393

[45] Date of Patent: Sep. 7, 1999

[54] IMAGE DISPLAY APPARATUS HAVING PHOSPHORS ARRANGED IN A CHECKERBOARD PATTERN AND ITS DRIVING METHOD

[75] Inventors: Kunihiro Sakai, Isehara; Hidetoshi Suzuki, Fujisawa, both of Japan

[73] Assignee: Canon Kabushiki Kaisha, Tokyo, Japan

[21] Appl. No.: 08/814,080

[22] Filed: Mar. 10, 1997

[30] Foreign Application Priority Data

| | | | |
|---|---|---|---|
| Mar. 11, 1996 | [JP] | Japan | 8-053079 |
| Mar. 5, 1997 | [JP] | Japan | 9-050200 |

[51] Int. Cl.[6] ..... G09G 3/22

[52] U.S. Cl. ..... 345/74; 345/75; 313/336

[58] Field of Search ..... 345/74, 75, 47, 345/55; 313/310, 336, 346 R

[56] References Cited

U.S. PATENT DOCUMENTS

| | | | |
|---|---|---|---|
| 5,066,883 | 11/1991 | Yoshioka et al. | 313/309 |
| 5,311,205 | 5/1994 | Hamada et al. | 345/88 |

FOREIGN PATENT DOCUMENTS

| | | | |
|---|---|---|---|
| 2714209 | 6/1995 | France | H01J 1/30 |
| 2721436 | 12/1995 | France | H01J 31/12 |
| 1031332 | 2/1989 | Japan | H01J 29/48 |
| 2257551 | 10/1990 | Japan | H01J 31/15 |
| 3055738 | 3/1991 | Japan | H01J 1/30 |
| 4028137 | 1/1992 | Japan | H01J 1/30 |

OTHER PUBLICATIONS

"The Emission of Hot Electrons and The Field Emission of Electrons From Tin Oxide", Radio Engineering and Electronic Physics, Jul. 1965, M.I. Elison et al.,pp. 1290–1296.

"Electrical Conduction and Electron Emission of Discontinuous Thin Films", G. Dittmer, Thin Film Solids, Jul. 4, 1971, pp. 317–328.

"Strong Electron Emission From Patterned Tin–Indinum Oxide Thin Films", M. Hartwell, et al., International Electronic Devices Meeting, 1975, Washington, DC, pp. 519–521.

"Electroforming and Electron Emission of Carbon Thin Films", H. Araki, et al., Journal of the Vacuum society of Japan, vol. 26, No. 1, 1983, pp. 22–29 (English Abstract).

"Field Emission", W.P. Dyke et al., Advances In Electron Physics, 1956, pp. 89–185.

"Physical Properties of Thin–Film Field Emission Cathodes With Molybdenum Cones", C.A. Spindt et al., Journal of Applied Physics, vol. 47, No. 12, Dec. 1996, pp. 5248–5263.

"Operation of Tunnel–Emission Devices", C.A. Mead, Journal of Applied Physics, vol. 32, No. 4, Apr. 1961, pp. 646–652.

*Primary Examiner*—Bipin H. Shalwala
*Assistant Examiner*—Ricardo Osorio
*Attorney, Agent, or Firm*—Fitzpatrick , Cella, Harper & Scinto

[57] ABSTRACT

In an image display apparatus which has a multi-electron beam source in which a plurality of electron emission elements are connected in a matrix pattern using a plurality of data electrodes and a plurality of scanning electrodes, and a fluorescent screen having phosphors of three primary colors R, G, and B corresponding to the electron emission elements, natural white color emission is obtained while suppressing a decrease in G luminance, using, e.g., a checkerboard layout which has a G spatial resolution higher than the R or B spatial resolution and includes more G phosphors than the R or B phosphors. For this purpose, the scanning electrodes connected to the electron emission elements corresponding to the G phosphors are electrically independent from those connected to the electron emission elements corresponding to the R or B phosphors, signal components corresponding to the G phosphors and signal components corresponding to the R or B phosphors are extracted from an image signal for a 1-line period, and the scanning electrode connected to the electron emission elements corresponding to the G phosphors and those connected to the electron emission elements corresponding to the R or B phosphors are selected during successively the 1-line period.

15 Claims, 25 Drawing Sheets

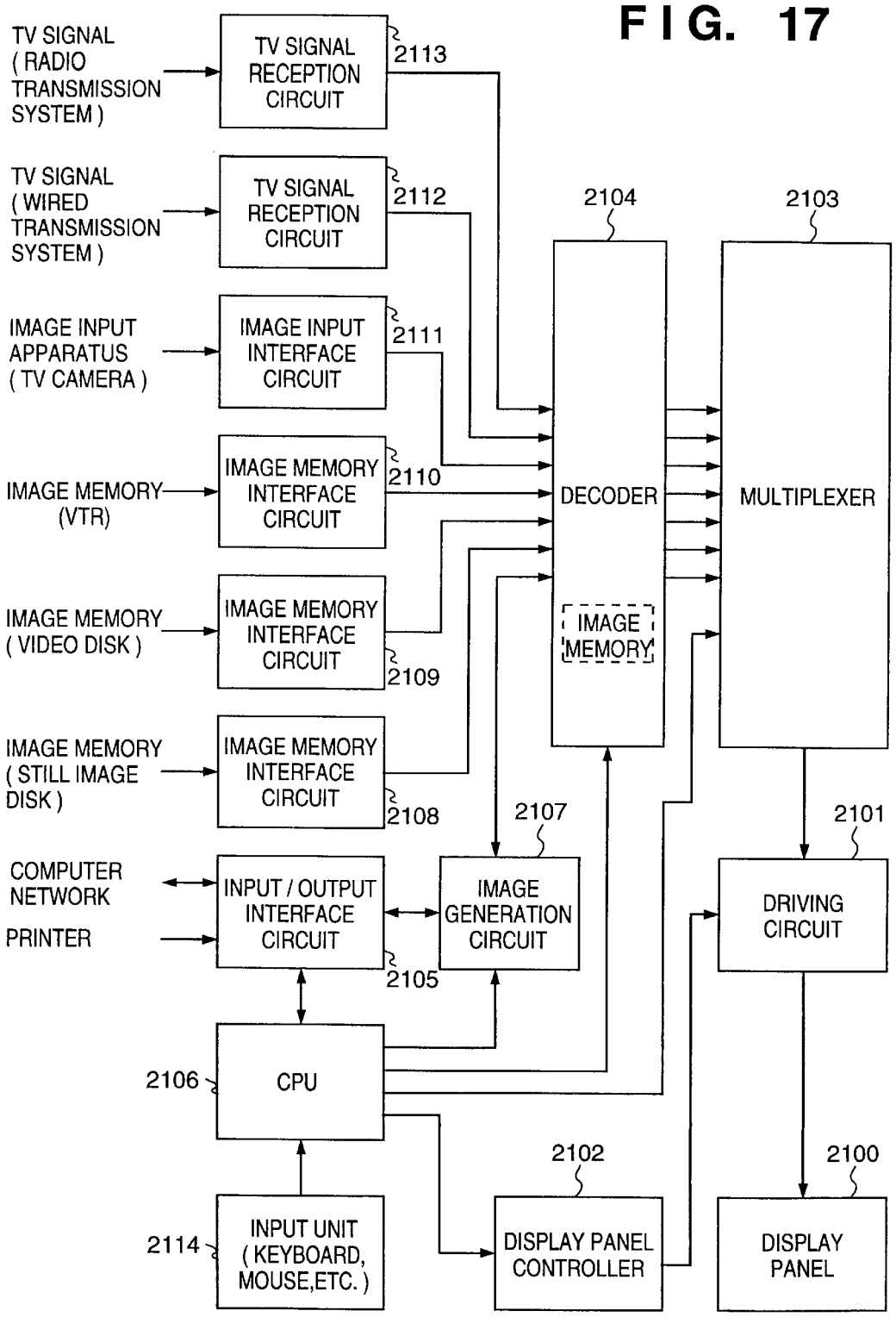
FIG. 17
TV SIGNAL (RADIO TRANSMISSION SYSTEM)
TV SIGNAL RECEPTION CIRCUIT
2113
TV SIGNAL (WIRED TRANSMISSION SYSTEM)
TV SIGNAL RECEPTION CIRCUIT
2112
IMAGE INPUT APPARATUS (TV CAMERA)
IMAGE INPUT INTERFACE CIRCUIT
2111
IMAGE MEMORY (VTR)
IMAGE MEMORY INTERFACE CIRCUIT
2110
IMAGE MEMORY (VIDEO DISK)
IMAGE MEMORY INTERFACE CIRCUIT
2109
IMAGE MEMORY (STILL IMAGE DISK)
IMAGE MEMORY INTERFACE CIRCUIT
2108
COMPUTER NETWORK
PRINTER
INPUT / OUTPUT INTERFACE CIRCUIT
2105
IMAGE GENERATION CIRCUIT
2107
2104
DECODER
IMAGE MEMORY
2103
MULTIPLEXER
2101
DRIVING CIRCUIT
2106
CPU
2114
INPUT UNIT (KEYBOARD, MOUSE,ETC.)
2102
DISPLAY PANEL CONTROLLER
2100
DISPLAY PANEL

IMAGE DISPLAY APPARATUS HAVING PHOSPHORS ARRANGED IN A CHECKERBOARD PATTERN AND ITS DRIVING METHOD

BACKGROUND OF THE INVENTION

The present invention relates to an image display apparatus which uses a multi-electron beam source having a plurality of electron emission elements in a matrix layout, and a fluorescent screen having R, G, and B phosphors corresponding to these electron emission elements, and its driving method.

In recent years, flat-panel type, large-screen display apparatuses have been studied and developed extensively. The present inventors have been studying flat-panel type, large-screen display apparatuses using cold cathodes as electron emission elements.

Conventionally, as electron emission elements, two different types of elements, i.e., thermionic cathode elements and cold cathode elements, are known. Of these elements, as cold cathode elements, for example, a field emission element (to be referred to as an FE type element hereinafter), a metal/insulating layer/metal emission element (to be referred to as an MIM type element hereinafter), and the like are known.

Surface conduction type emission elements include, for example, elements described in M. I. Elinson, *Radio Eng. Electron Phys.*, 10, 1290 (1965) and other elements to be described later.

The surface conduction type emission element utilizes a phenomenon in that electron emission occurs when currents are flowed in a direction parallel to the surface of a small-area thin film formed on a substrate. As surface conduction type emission elements, in addition to the above-mentioned element using an $SnO_2$ thin film by Elinson et al., an element using an Au thin film [G. Dittmer: "Thin Solid Films", 9, 317 (1972)], an element using an $In_2O_3/SnO_2$ thin film [M. Hartwell and C. G. Fondtad: "IEEE Trans. ED Conf.", 519 (1975)], an element using a carbon thin film [Hisashi Araki et al.: *Vacuum*, Vol. 26, No. 1, 22 (1983)], and the like have been reported.

FIG. 18A is a plan view of the above-mentioned element by M. Hartwell et al, as a typical example of the element structure of such surface conduction type emission element. In FIG. 18A, reference numeral 3001 denotes a substrate; and 3004, a conductive thin film consisting of a metal oxide formed by sputtering. The conductive thin film 3004 is formed into an H-shaped flat pattern, as shown in FIG. 18A. An electron emission portion 3005 is formed by performing an energization process called energization forming (to be described later) on the conductive thin film 3004. The interval L in FIG. 18A is set to fall within the range from 0.5 to 1 [mm], and the width W is set to be 0.1 [mm]. Note that FIG. 18A illustrates the electron emission portion 3005 as a rectangular portion formed at the center of the conductive thin film 3004 for the sake of illustrative convenience, but it does not necessarily faithfully express the position or shape of the actual electron emission portion.

In the above-mentioned surface conduction type emission elements such as the element by M. Hartwell et al., it is a common practice to form the electron emission portion 3005 by performing an energization process called energization forming on the conductive thin film 3004 before electron emission. More specifically, in the energization forming the electron emission portion 3005 is formed in an electrically high-resistance state in such a manner that the conductive thin film 3004 is locally destroyed, deformed, or denatured by applying a constant DC voltage or a DC voltage that increases at a very slow rate (e.g., about 1 V/min) across the two ends of the conductive thin film 3004. Note that a fissure is formed on a portion of the locally destroyed, deformed, or denatured conductive thin film. When an appropriate voltage is applied to the conductive thin film after the energization forming, electron emission occurs in the neighborhood of the fissure.

On the other hand, as the FE type elements, for example, an element by W. P. Dyke & W. W. Dolan, "Field emission", *Advance in Electron Physics*, 8, 89 (1956), an element by C. A. Spindt, "Physical properties of thin-film field emission cathodes with molybdenum cones", *J. Appl. Phys.*, 47, 5248 (1976), and the like are known.

FIG. 18B is a sectional view of the above-mentioned element by C. A. Spindt et al., as an example of the typical element arrangement of the FE type element. Referring to FIG. 18B, reference numeral 3010 denotes a substrate; 3011, an emitter wiring layer or interconnect consisting of a conductive material; 3012, an emitter cone; 3013, an insulating layer; and 3014, a gate electrode. This element causes electron emission from the distal end portion of the emitter cone 3012 by applying an appropriate voltage across the emitter cone 3012 and the gate electrode 3014.

In another element arrangement of the FE type element, the emitter and the gate electrode are juxtaposed on the substrate to be nearly parallel to the substrate surface in place of the stacked structure shown in FIG. 18B.

As an example of the MIM type element, an element by C. A. Mead, "Operation of Tunnel-emission Devices, *J. Appl. Phys.*, 32, 646 (1961), or the like is known. FIG. 19 shows a typical example of the element structure of the MIM type element. FIG. 19 is a sectional view. Referring to FIG. 19, reference numeral 3020 denotes a substrate; 3021, a metal lower electrode; 3022, a thin insulating layer having a thickness of about 100 Å; and 3023, a metal upper electrode having a thickness of about 80 to 300 Å. The MIM type element causes electron emission from the surface of the upper electrode 3023 upon application of an appropriate voltage across the upper and lower electrodes 3023 and 3021.

The above-mentioned cold cathode elements do not require any heaters since they can obtain electron emission at relatively low temperatures as compared to the thermionic cathode elements. Therefore, the cold cathode element has a simpler structure than the thermionic cathode element, and a very small element can be formed. Even when a large number of elements are arranged on a substrate at a high density, the problem of, e.g., melting of the substrate by heat hardly occurs. The thermionic cathode element has a low response speed since it operates upon heating of a heater, while the cold cathode element has a high response speed.

For these reasons, extensive studies have been made to explore effective applications of the cold cathode element. For example, since the surface conduction type emission element has a simplest structure and allows easiest fabrication among the cold cathode elements, a large number of elements can be formed over a large area. Hence, the method of driving an array of a large number of elements has been studied, as disclosed in Japanese Patent Laid-Open No. 64-31332 by the present applicant.

As for applications of the surface conduction type emission element, for example, image forming apparatuses such as an image display apparatus, an image recording apparatus, and the like, a charged beam source, and the like have been studied. In particular, as an application to the image display apparatus, as disclosed in U.S. Pat. No. 5,066,883 and Japanese Patent Laid-Open Nos. 2-257551 and 4-28137 by the present applicant, an image display apparatus which uses a combination of the surface conduction type emission element and a phosphor that emits light upon irradiation of an electron beam has been studied. The image display apparatus which uses a combination of the surface conduction type emission element and the phosphor is expected to have higher characteristics than conventional image display apparatuses. For example, the image display apparatus of this type is superior to liquid crystal display apparatuses that have become popular in recent years, since it is of spontaneous emission type and requires no backlight, and has a wide viewing angle.

The method of driving an array of a large number of FE type elements is disclosed in, e.g., U.S. Pat. No. 4,904,895 by the present applicant. As an example of an application of the FE type element to an image display apparatus, a flat-panel type display apparatus reported by R. Meyer et at. is known [R. Meyer, "Recent Development on Microtips Display at LETI", Tech. Digest of 4th Int. Vacuum Microelectronics Conf., Nagahama, pp. 6–9 (1991)].

Also, an example of application of an array of a large number of MIM type elements to an image display apparatus is disclosed in, e.g., Japanese Patent Laid-Open No. 3-55738 by the present applicant. As the conventional pixel layout of such image display apparatus, a stripe layout in which three, R, G, and B phosphors arranged in the horizontal direction constitute one pixel is popularly used. However, in this stripe layout, when each phosphor has a nearly square shape, as shown in FIG. 20A, a pixel as a set of R, G, and B is horizontally elongated, and the horizontal resolution is lowered. On the other hand, since phosphors of identical colors are arranged in the vertical direction, vertical stripes are conspicuous when an image is displayed.

In order to solve such problems, a checkerboard layout in which R:G:B phosphors are arranged in a checkerboard pattern at a ratio of 1:2:1 has been proposed. Since each pixel as a set of R, G, and B extends over a plurality of rows of a phosphor array of the display apparatus, and is not horizontally elongated unlike in the stripe layout, the horizontal resolution is higher than that in the stripe layout. Furthermore, since phosphors of identical colors are not arranged in the vertical direction, vertical stripes are not conspicuous.

On the other hand, paying attention to the fact that the spatial resolution of the sense of sight with respect to luminance is higher than that with respect to hue, a method of positively setting the total number of G picture elements that contribute greater to luminance to be larger than those of R and B in place of the checkerboard layout is adopted.

A conventional method of driving such display apparatus which must scan a plurality of signal lines to display one pixel which consist of R, G, G, B elements since each pixel extends over a plurality of rows of the display apparatus will be described below. A case will be exemplified below wherein an NTSC signal is displayed on a display apparatus having 240 phosphors in the vertical direction×480 phosphors in the horizontal direction. The number of lines per field of the NTSC signal is 262.5, and signal components for the central 240 lines of these lines are assumed to be extracted and displayed in this example.

(First Display Method)

As the first display method, a method of displaying the first-line data of an input signal to be displayed on the first row of a panel, the second-line data of the input signal on the second row of the panel, . . . , the n-th-line data of the input signal on the n-th row of the panel will be examined below. Since the phosphor layout of the panel is the checkerboard layout, each odd-numbered row of the panel includes only G and R phosphors but no B phosphors, and each even-numbered row of the panel includes only B and G phosphors but no R phosphors. Therefore, in this display method, B signals on the odd-numbered lines of the input signal and R signals on the even-numbered lines are not displayed, and information is lost. In order to solve this problem, a vertical LPF (low-pass filter) must be used.

(Second Display Method)

A display method of displaying data obtained by filtering the first- and second-line data of an input signal by the vertical LPF on the first and second rows of the panel, displaying data obtained by filtering the third- and fourth-line data of the input signal by the vertical LPF, on the third and fourth rows of the panel, . . . , displaying data obtained by filtering the n-th- and (n+1)-th-line data of the input signal by the vertical LPF on the n-th and (n+1)-th rows of the panel will be described below.

FIG. 21 is a block diagram of a circuit for driving this display apparatus, and FIG. 22 is a timing chart upon driving the apparatus. An explanation will be given with reference to FIG. 21. An NTSC signal s1 is color-separated into three primary colors R, G, and B by a decoder 2. These three primary color signals s3, s4, and s5 are filtered by a horizontal LPF, and are then A/D-converted into digital signals s7, s8, and s9 by an A/D converter 6. The signals s7, s8, and s9 for two lines are filtered by a vertical LPF 10. The filtered signals are re-arranged by a signal re-arranging circuit 11 to match the phosphor layout of the panel. For example, since this example assumes the checkerboard layout as the phosphor layout, only G and R phosphors appear on each odd-numbered row, and only B and G phosphors appear on each even-numbered row, as shown in FIG. 20B. Hence, the signal re-arranging circuit 11 extracts only G and R data from signals to be displayed on the even-numbered rows of the panel (signals output from the vertical LPF), and alternately arranges them. Also, the circuit 11 extracts only B and G data from signals to be displayed on the odd-numbered rows of the panel (signals output from the vertical LPF) and alternately arranges them. Then, the circuit 11 outputs these signals to a shift register 12. After 480 data in the horizontal direction are stored in the shift register, the shift register transfers these data to a 1-line memory 13.

These data held in the 1-line memory 13 are sent to a panel 16 in response to a 1-line reading clock s15 generated by a control pulse generator 14. In synchronism with this signal, a scanning signal is supplied from a scanning signal generator 17 to the panel 16, thus displaying an image.

An explanation will be given with reference to FIG. 22. An NTSC signal s1 is separated into three primary color signals by the decoder 2, and the separated signals are A/D-converted into signals s7, s8, and s9 by the A/D converter 6. The signals for two lines (by calculating the average of two lines) are filtered by the LPF 10 in the vertical direction, and the signal re-arranging circuit 11 re-arranges the signals in correspondence with the phosphor layout of the panel. The circuit 11 then sends signals to the shift register 12. After signals for one row are stored in the shift register 12, these signals are transferred to the 1-line memory 13 and are held. The held signals are supplied to the panel in response to a 1-line reading clock s15, and an image is displayed on the scanning line of the panel, which is synchronized with the clock. At this time, the signals filtered by the vertical LPF are displayed by the following method. That is, data obtained by filtering the first- and second-line data of an input signal by the vertical LPF are displayed on the first and second rows of the panel, data obtained by filtering the third- and fourth-line data of the input signal by the vertical LPF are displayed on the third and fourth rows of the panel, . . . , data obtained by filtering the n-th- and (n+1)-th-line data of the input signal by the vertical LPF are displayed on the n-th and (n+1)-th rows of the panel. In this manner, when signals filtered by the vertical LPF are displayed, image information can be prevented from being lost.

(Third Display Method)

A display method of displaying data obtained by filtering the first- and second-line data of an input signal by the vertical LPF on the first row of the panel, displaying data obtained by filtering the second- and third-line data of the input signal by the vertical LPF on the second row of the panel, . . . , displaying data obtained by filtering the n-th- and (n+1)-th-line data of the input signal by the vertical LPF on the n-th row of the panel will be described below.

The driving block diagram of this display method is the same as that in FIG. 21. FIG. 23 is a timing chart of this display method. The third and second display methods are substantially the same except for the following points. In the second display method, signals obtained by filtering the first- and second-line data of an input signal by the vertical LPF are displayed on the first and second rows of the panel. However, in the third display method, signals obtained by filtering the first- and second-line data of an input signal by the vertical LPF are displayed on the first row of the panel, and signals obtained by filtering the second- and third-line data of the input signal by the vertical LPF are displayed on the second row of the panel. In the second display method, signals obtained by filtering the third- and fourth-line data of an input signal by the vertical LPF are displayed on the third and fourth rows of the panel. On the other hand, in the third display method, signals obtained by filtering the third- and fourth-line data of an input signal by the vertical LPF are displayed on the third row of the panel, and signals obtained by filtering the fourth- and fifth-line data of the input signal by the vertical LPF are displayed on the fourth row of the panel. That is, in the second display method, signals obtained by filtering n- and (n+1)-th line data (n is an odd number) by the LPF are displayed on the n-th and (n+1)-th rows of the panel, while in the third display method, signals obtained by filtering n-th and (n+1)-th line data (n is a natural number) by the LPF are displayed on the n-th row of the panel, and signals obtained by filtering (n+1)-th and (n+2)-th line data by the LPF are displayed on the (n+1)-th row of the panel. In FIG. 23, the way of filtering by the vertical LPF 10 is different from that in the second display method. With this display method, image information can be prevented from being lost, and a higher vertical resolution than in the second display method can be obtained.

In the above-mentioned prior arts, the total number of G picture elements which contribute greater to luminance is set to be larger than those of R and B. In this way, natural white color emission cannot be obtained unless each G phosphor area is set to be smaller than those of R and B or the electron beam radiation energy to G is reduced.

Fabricating a fluorescent screen on which the phosphor areas vary in the individual picture elements may result in a complicate process of forming very small phosphors and may lower the yield when a high resolution is to be assured.

On the other hand, reducing electron beam radiation energy to G can be attained by an electrical means. For example, in the prior art shown in FIG. 21, the intensity ratio of a G signal of the decoded R, G, and B signals is set to be smaller than those of R and B signals, thus obtaining natural white color emission. More specifically, a means for adjusting the attenuation or amplification factor (gain) of an input section (not shown) of the A/D converter 6 need only be arranged. Of course, a means for changing the intensity ratio of A/D-converted R, G, and B signals may be used.

In the field of liquid crystal display apparatuses, an apparatus disclosed in U.S. Pat. No. 5,311,205 (Hamada et al.) is known.

Hamada et al. connect signal electrodes used for applying a modulation signal in units of colors upon arranging R, G, and B color picture elements in a checkerboard pattern. This apparatus has a merit of obviating the necessity of arranging color signal selection switches in units of signal electrodes. However, as a matter associated with the problems to be solved by the present invention (to be described later), in the apparatus by Hamada et al., it should be noted that scanning electrodes are constituted by common electrodes for R and B and common electrodes for B and G.

However, in the above-mentioned prior art, since the electron beam radiation energy to G is reduced to maintain white balance, the peak luminance of the entire display apparatus lowers. The luminance is one of the most important specifications in an image display apparatus, and is an element that has a large influence on the product price, arrangement, applications, and the like in some cases.

A decrease in luminance is caused by setting the electron emission energy per unit time during the selection period of G picture elements to be smaller than those of R and B picture elements.

In the above-mentioned prior arts, since R and G, and B and G are mixed on scanning electrodes, it is difficult to independently change the selection period of G picture elements and the selection period of R and B picture elements.

SUMMARY OF THE INVENTION

As a result of extensive studies of the present inventors to solve the above-mentioned problems, the following invention was achieved. That is, according to the present invention, an image display apparatus which has a multi-electron beam source in which a plurality of electron emission elements are connected in a matrix using a plurality of data electrodes and a plurality of scanning electrodes, and a fluorescent screen having phosphors of three primary colors R, G, and B corresponding to the electron emission elements, is characterized in that the fluorescent screen has a ratio of G phosphors larger than that of R or B phosphors, and the multi-electron beam source electrically independently has scanning electrodes connected to the electron emission elements corresponding to the G phosphors and scanning electrodes connected to the electron emission elements corresponding to the R or B phosphors.

At this time, the phosphors are preferably arranged in a checkerboard pattern to have an area ratio R:G:B=1:2:1. Also, the selection period of a scanning electrode connected to the electron emission elements corresponding to the G phosphors is preferably set to be about ½ the selection period of a scanning electrode connected to the electron emission elements corresponding to the R or B phosphors. Furthermore, preferably, output signals corresponding to the G phosphors and output signals corresponding to the R or B phosphors are extracted from an image signal for a 1-line period, and a scanning electrode connected to the electron emission elements corresponding to the G phosphors and a scanning electrode connected to the electron emission elements corresponding to the R or B phosphors are preferably selected during the 1-line period. At this time, the image signal for the 1-line period is divided into signals for two rows, and the scanning electrodes for two rows are selected during the 1-line period, and a portion of the rows selected during the 1-line period can be selected again during the next 1-line period. The electron emission elements may comprise any of surface conduction type emission elements, FE type electron emission elements, and MIM type electron emission elements.

The present invention also includes the invention of the driving method of the image display apparatus. More specifically, according to the present invention, a driving method of an image display apparatus which has a multi-electron beam source in which a plurality of electron emission elements are connected in a matrix using a plurality of data electrodes and a plurality of scanning electrodes, and a fluorescent screen having phosphors of three primary colors R, G, and B corresponding to the electron emission elements, is characterized in that the ratio of G phosphors is larger than that of R or B phosphors, the scanning electrodes connected to the electron emission elements corresponding to the G phosphors are electrically independent of the scanning electrodes connected to the electron emission elements corresponding to the R or B phosphors, signals corresponding to the G phosphors and signals corresponding to the R or B phosphors are extracted from an image signal for a 1-line period, and a scanning electrode connected the electron emission elements corresponding to the G phosphors and a scanning electrode connected to the electron emission elements corresponding to the R or B phosphors are selected during the 1-line period.

According to the present invention, in a display apparatus in which R, G, and B picture elements are arranged in a checkerboard pattern, the luminance can be increased more than the conventional apparatus while maintaining appropriate color balance. More specifically, in the present invention, the arrangement of the scanning electrodes is divided into G scanning electrodes, and B and R common scanning electrodes, so that the G scanning electrodes alone can be independently scanned. The output electron beam intensity of the electron emission elements for G is set to be equivalent to those of the electron emission elements for R and B, while the scanning time of G is set to be shorter than those of R and B. As a consequence, good color balance can be maintained without decreasing the output beam intensity of G, the number of picture elements of which is larger than other picture elements. Since the G scanning electrodes are independently scanned, and its scanning time is shortened as compared to the conventional apparatus, a time margin is obtained. The present invention distributes this time margin to G, B, and R at the ratio of 1:2:2 as the driving periods, thus increasing the luminance as compared to the conventional apparatus.

A case will be exemplified below wherein a white image is to be displayed. If VS represents the time required for forming one frame, the total of driving times assigned to R is ¼ of VS in the conventional apparatus. In contrast to this, in the apparatus of the present invention, ⅓ of VS can be assigned to R. Accordingly, the luminance can be increased by ½ while maintaining white balance.

According to the present invention, a display apparatus which can increase the spatial resolution of the displayed image, and can obtain natural white color emission while suppressing a decrease in luminance can be realized. Furthermore, the present invention achieves the above-mentioned items without complicating the driving circuit or the electrode forming process. Since the display apparatus performance can be remarkably improved without causing any increase in manufacturing cost or decrease in yield, the cost performance of products can be relatively greatly improved.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 17 is a block diagram of a multi-function image display apparatus according to an embodiment of the present invention;

DETAILED DESCRIPTION OF THE PREFERRED EMBODIMENTS

Figure 1:
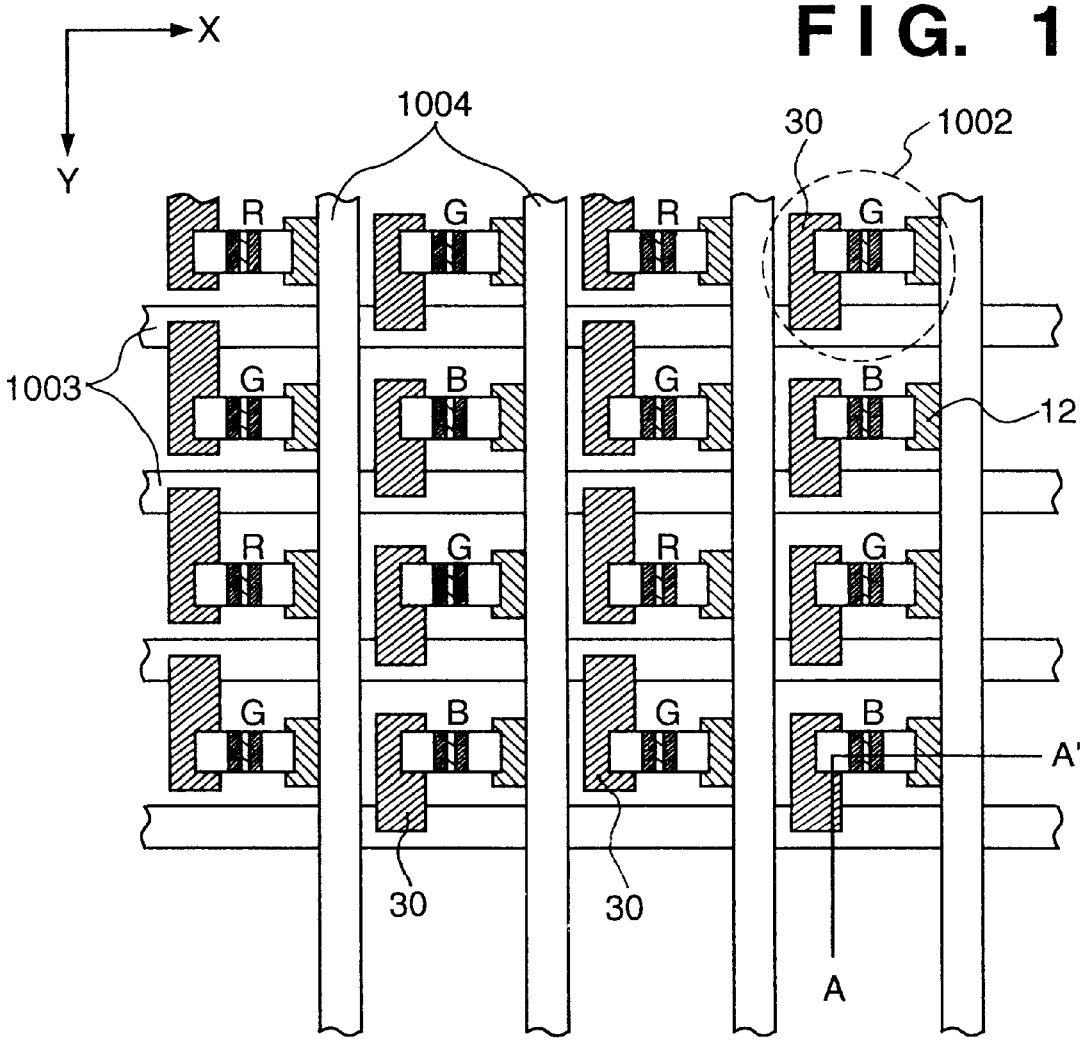
FIG. 1 is a plan view of a substrate of a multi-electron beam source used in an embodiment of the present invention.

FIG. 1 is a plan view of a multi-electron beam source used in a display panel of this embodiment. Cold cathode elements 1002 are arranged as a plurality of electron emission elements on a substrate (not shown), and these elements are connected in a simple matrix pattern by row electrodes 1003 and column electrodes 1004. In each crossing portion between the row and column electrodes 1003 and 1004, an insulating layer (not shown) is formed between the electrodes to assure electrical isolation. A portion constituted by the elements and electrodes 1002 to 1004 and the substrate will be referred to as a multi-electron beam source hereinafter. Note that the fabrication method and structure of the multi-electron beam source will be described in detail later.

Figure 20A:
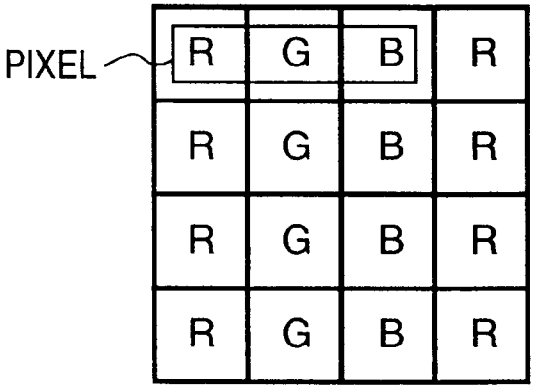
FIGS. 20A and 20B are views respectively showing the stripe layout and checkerboard layout of phosphors.
Figure 20B:
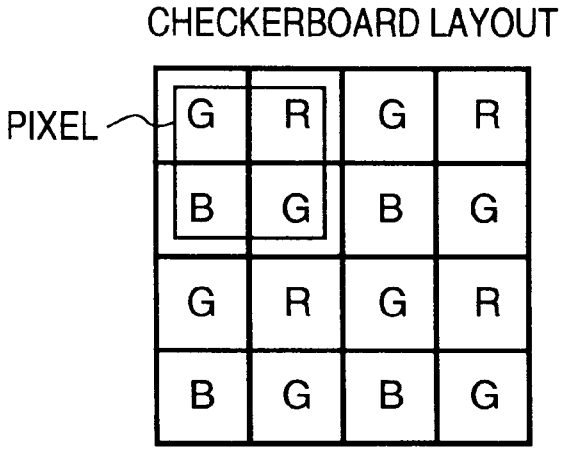

The multi-electron beam source is arranged to face a faceplate (not shown) on which R, G, and B phosphors are selectively printed in a checkerboard pattern, as shown in, e.g., FIG. 20B, and a combination of each cold cathode element 1002 and the opposing phosphor form a picture element. Each cold cathode element 1002 is connected to the row and column electrodes 1003 and 1004 via an element electrode 30, as shown in FIG. 1.

In this embodiment, the element electrodes 30 of neighboring picture elements are alternately connected to different row electrodes 1003. With this arrangement, the checkerboard pattern is maintained on the phosphor surface, and paying attention to one row electrode 1003, a multi-electron beam source in which the cold cathode elements 1002 for G picture elements are connected independently from the cold cathode elements 1002 for R and B picture elements can be realized.

A method of displaying an NTSC signal using the above-mentioned multi-electron beam source will be described below. Assume that the number of phosphors is 480 (horizontal)×240 (vertical).

Figure 2:
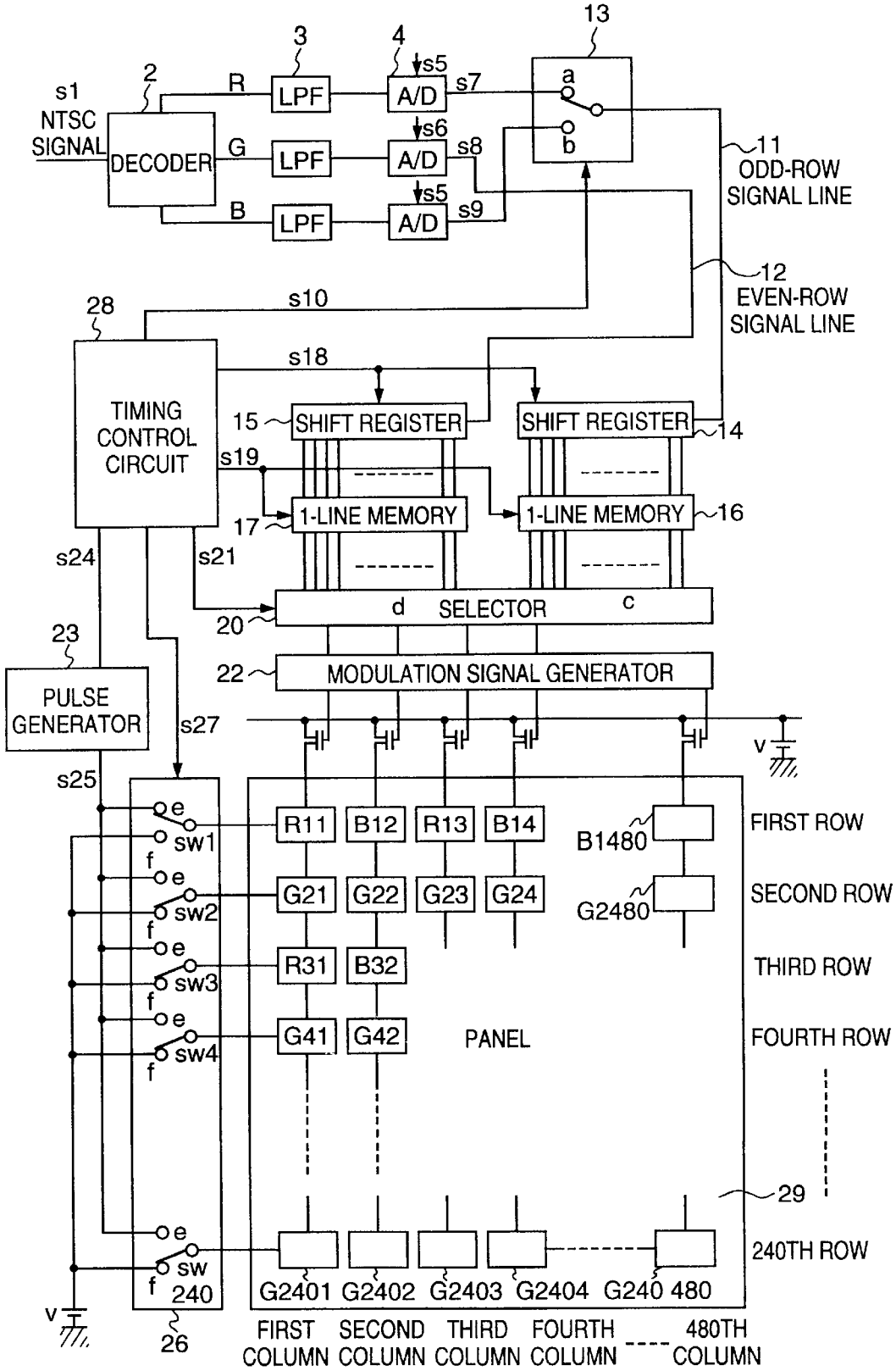
FIG. 2 is a block diagram of a driving circuit used in the embodiment of the present invention.

FIG. 2 shows a panel driving circuit of this embodiment.

The panel driving circuit comprises a decoder 2, horizontal analog LPFs 3, A/D converters 4, an odd-row signal line 11, an even-row signal line 12, a signal selection switch 13, odd- and even-row shift registers 14 and 15, an odd-row 1-line memory 16, an even-row 1-line memory 17, a selector 20, a modulation signal generator 22, a pulse generator 23, a scanning row selection switch 26, a timing control circuit 28, and a panel 29. In this embodiment, two shift registers and two 1-line memories are arranged.

The operation will be explained below.

(Decoder 2)

An input NTSC signal s1 is color-separated into three primary color signals R, G, and B by the decoder 2.

(LPF 3)

These color-separated signals are filtered by the horizontal analog LPFs 3. This is to remove high-frequency components from the color-separated signals which are to be subjected to A/D conversion in the next A/D converters 4.

(A/D Converter 4)

The R, G, and B analog signals are A/D-converted by the A/D converters 4 to obtain R, G, and B digital signals s7, s8, and s9. Two different sampling clocks, s5 for the R and B signals and s6 for the G signal are input to the A/D converter 4.

The phosphor layout adopted by this panel is a checkerboard layout (R:G:B=1:2:1), as shown in FIG. 20B. With this layout, when a 1-line signal is to be displayed on one row of the panel, since either the B or R phosphors are not present in the row and either the B or R signal cannot be displayed, this embodiment displays the 1-line signal using two consecutive rows of the panel. For this reason, since these two rows (for displaying the 1-line signal) include G phosphors twice the R and B phosphors, the frequency of the G sampling clocks s6 is twice that of the R/B sampling clocks s5. Of these A/D-converted signals, the R and B signals s7 and s9 have 240 data ½ of the number of phosphors, in the horizontal direction, of the panel, and the G signal has 480 data.

These data are signal components to be displayed on the two rows of the panel.

(Odd-row Signal Line 11, Even-row Signal Line 12)

Although the panel of this embodiment adopts the checkerboard phosphor layout, elements corresponding to R and B phosphors alternately appear on odd-numbered rows, and elements corresponding to G phosphors appear on even-numbered rows on the electrical signal electrodes like R11, B12, R13, . . . R1480 on the first row, G21, G22, G23, . . . G2480 on the second row, and so on. Accordingly, as shown in FIG. 2, the odd-row signal line 11 and the even-row signal line 12 are prepared to independently process signals for the odd- and even-numbered rows.

With this phosphor layout on the panel, B and R signals are flowed through the odd-row signal line 11, and a G signal is flowed through the even-numbered signal line 12. The A/D-converted 240 B signal components s9 and 240 R signal components s7 are alternately flowed through the odd-row signal line 11, and the A/D-converted 480 G signal components s8 are flowed through the even-row signal line 12.

(Selection Switch 13)

The selection switch 13 generates signals to be alternately flowed through these two signal lines (s7, s9). When the switch is connected to the terminal a side, an R signal is flowed through the signal line 11; when the switch is connected to the terminal b side, a B signal is flowed through the signal line 11. Accordingly, this switch is switched 480 times during one horizontal synchronization period (1H). A signal for switching this switch is a selection signal s10.

The signals flowed through these signal lines 11 and 12 are respectively those to be displayed on the odd- and even-numbered rows of the panel.

(Shift Registers 14, 15)

These signals flowed through the odd- and even-row signal lines as described above are concurrently serial-to-parallel (S/P)-converted by the shift registers 14 and 15 on the basis of shift clocks s18. 480 shift clocks s18 are generated during 1H.

After signal components for one row of the panel are S/P-converted by the shift registers, the shift registers output these signal components to the 1-line memories 16 and 17 and receive signal components for the next row.

(1-line Memories 16, 17)

The two 1-line memories 16 and 17 are also prepared in correspondence with the odd- and even-numbered rows, and respectively hold signals input from the odd- and even-row shift registers 14 and 15. For this reason, the odd-row 1-line memory 16 holds R and B signal components, and the even-row 1-line memory 17 holds G signal components.

These signal components are present on each 1-line memory for 1H.

The held signals are supplied to the selector 20 in response to 1-line signal reading clocks s19.

(Selector 20)

Upon scanning the odd-numbered row of the panel, the selector 20 selects a terminal c (R and B signals); upon scanning the even-numbered row, it selects a terminal d (G signal), thus sending out signals. The selector 20 is switched in response to a selector switching control signal s21.

The signal components selected by the selector are pulse-width-modulated by the modulation signal generator 22, and the modulated signal components are supplied to the gates of the MOS-FETs.

In this embodiment, gradation expression is attained by pulse-width modulation but may be attained by amplitude modulation or by both amplitude modulation and pulse-width modulation.

(Effective Signal)

Figure 3A:
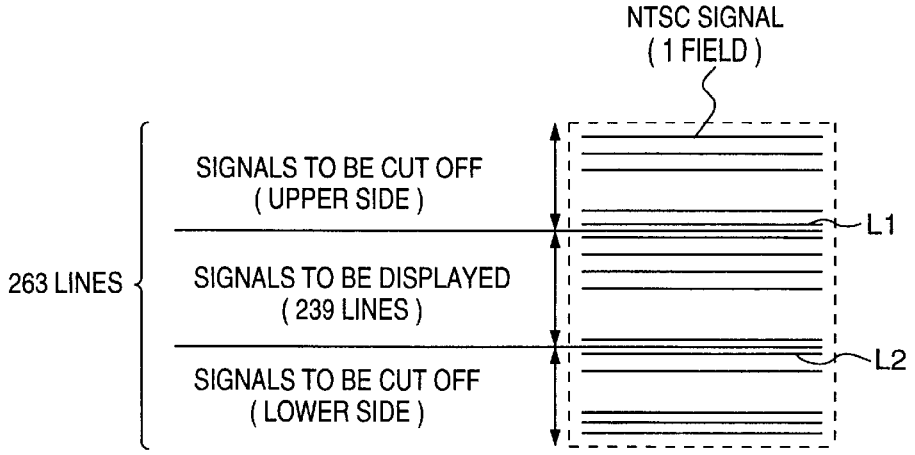
FIGS. 3A and 3B are respectively a view showing signals displayed on a panel, and a view showing the scanning order of the panel.

An NTSC signal includes video signals for about 263 lines per field. However, the panel of this embodiment can only display signals for about 240 lines. For this reason, the present invention cuts off signals in upper and lower portions of those for the 263 lines, and displays signals for about 240 lines in the central portion, as shown in FIG. 3A. As shown in FIG. 3A, L1 represents the lowermost signal of those in the upper portion to be cut off, and L2 represents the uppermost signal of those in the lower portion to be cut off. Only the G and R components of the signal L1 and B and G components of the signal L2 are respectively displayed on the uppermost and lowermost rows of the phosphor screen.

(Scanning Order)

Figure 4:
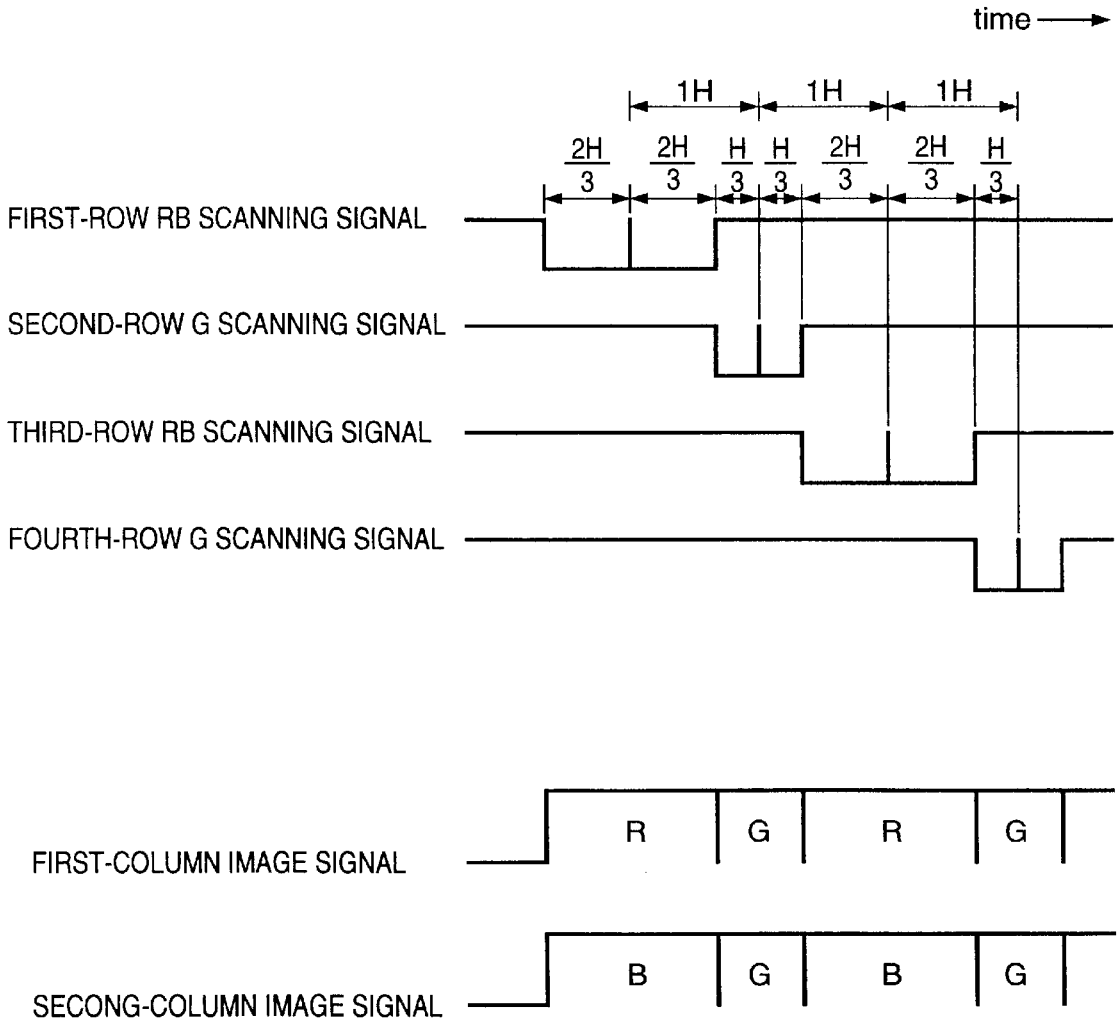
FIG. 4 is a timing chart showing the timings of scanning signals and image signals.

This panel displays a 1H signal using two rows (to be temporarily referred to as line1 and line2), as described above. These two rows are scanned not concurrently but sequentially by dividing the duration 1H into two periods, i.e., the upper row (line1) is scanned during the former period and the second row (line2) is scanned during the latter period. At this time, in this embodiment, the row connected to G picture elements is selected for a ⅓H scanning time, and the row connected to the R or B picture elements is selected for a ⅔H scanning time. The pulse-width-modulated signals are output during the selected periods. The ratio of selection periods need only be determined to obtain natural white color emission and to increase luminance, and is set to be about 1:2 in consideration of the picture element ratio of G:R or B. However, the present invention is not limited to such specific ratio. In driving method of this embodiment, each row of the panel is scanned twice like the first row, first row, second row, second row, third row, third row, . . . , 240th row, 240th row, so that a 1H signal corresponding to the row of interest is displayed during first scanning, and a 1H signal corresponding to the next row is displayed during the second scanning. FIG. 4 shows this state.

Figure 3B:
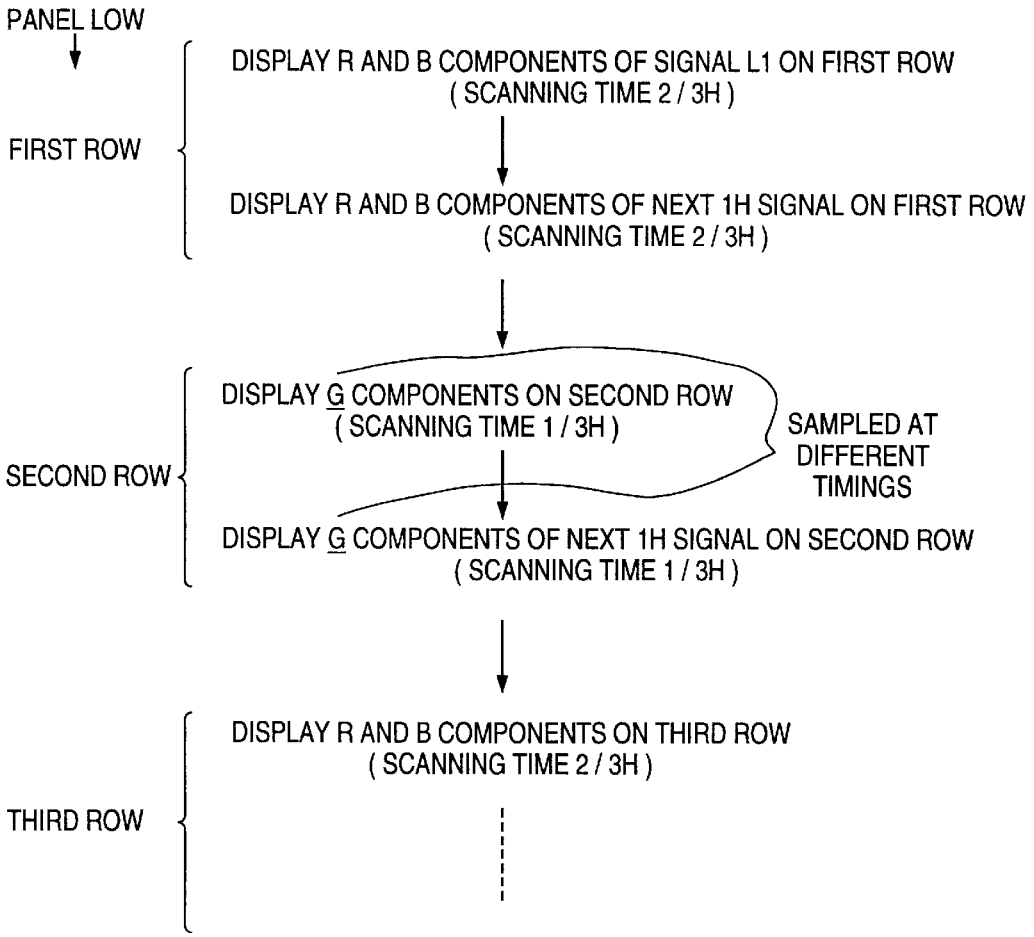

The display method will be described in more detail below with reference to FIG. 3B.

First, signals from a 1H signal at the beginning of one field to a signal immediately before the signal L1 in FIG. 3A are discarded, and signals from the signal L1 are displayed. The signal L1 is displayed on the first row of the panel by selecting R and B components of the signal L1 held in the 1-line memory 16 when the selector 20 selects its terminal c. At this time, as described above, the scanning time is ⅔H. Note that G component of the signal L1 held in the 1-line memory 16 is not displayed on the panel. Upon completion of the display for the first row, a 1-line signal next to the signal L1 is held in the 1-line memories 16 and 17. Of the held signal components, R and B signal components in the 1-line memory 16 are selected by the selector 20 (c), and are displayed on the first row of the panel (scanning time ⅔H). After an elapse of the ⅔ scanning time, the selector 20 selects its terminal d (the 1-line memory 17) in response to the selector switching control signal s21, and G components of the 1-line signal are displayed on the second row of the panel (scanning time ⅓H). Upon completion of the display for the second row, the next 1-line signal components are held on the 1-line memories 16 and 17, and are sequentially displayed on the second, third, . . . rows by the same method as described above.

A certain row of interest displays a given 1-line signal, and then displays the next 1-line signal after an elapse of ⅔H or ⅓H times. Since the human eyes cannot follow such fast changes, a person observes these signals as if the average value of these two 1-line signals were displayed. With the above-mentioned display method, the average value of signals for 2H can be displayed without filtering them by any vertical LPF circuit.

Figure 21:
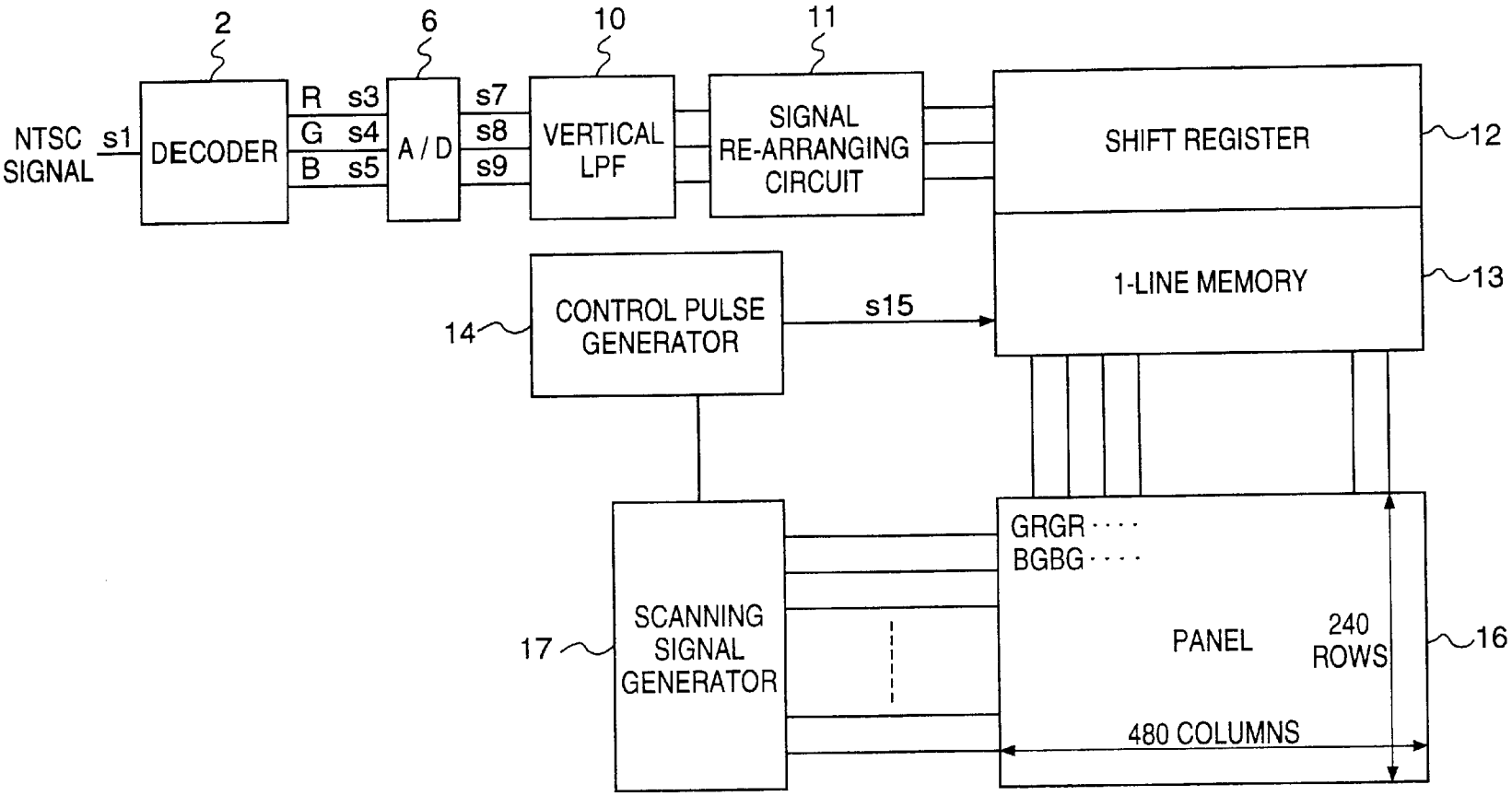
FIG. 21 is a block diagram of a circuit for driving a display apparatus.
Figure 22:
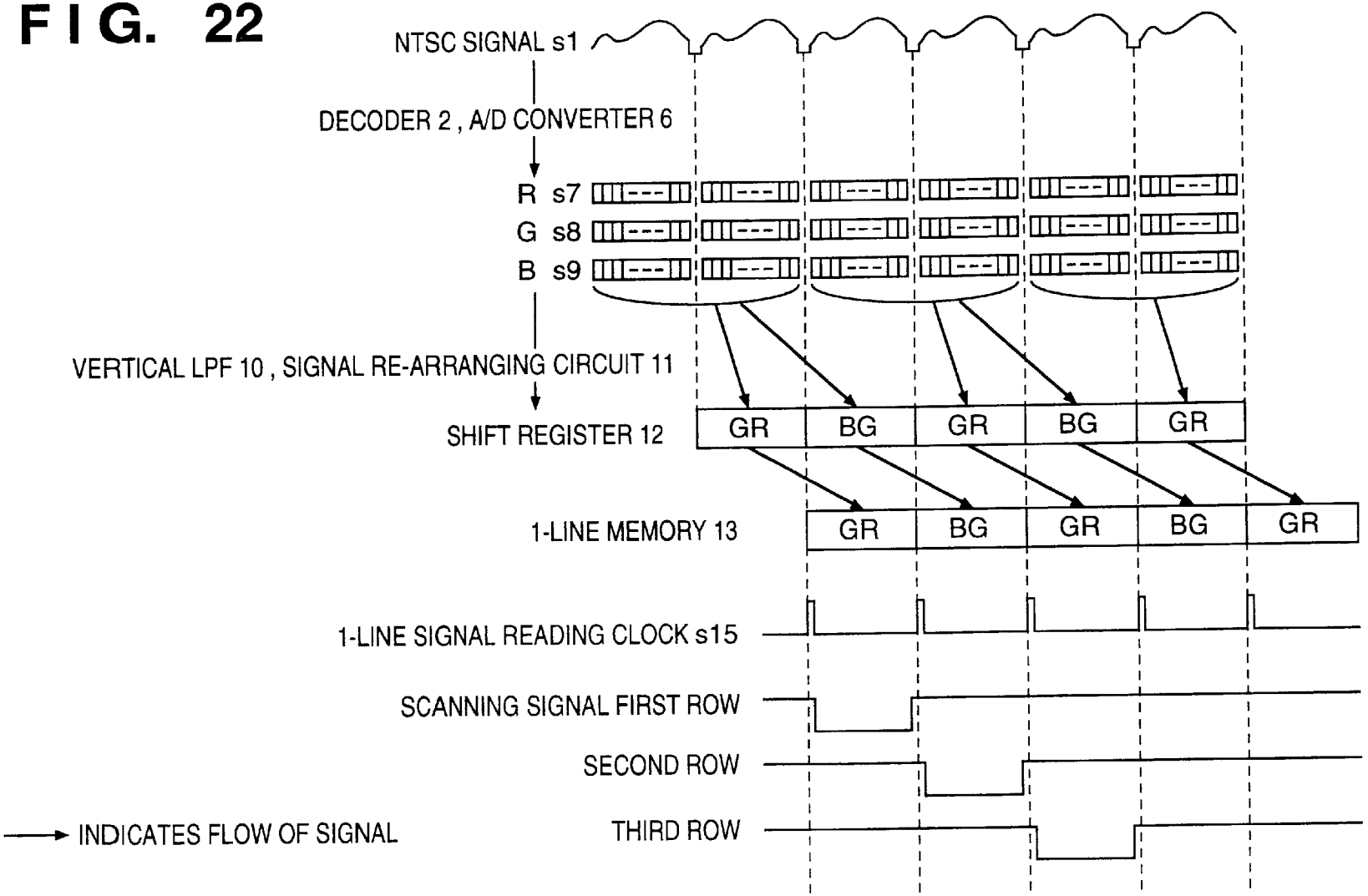
FIG. 22 is a timing chart of the second display method.
Figure 23:
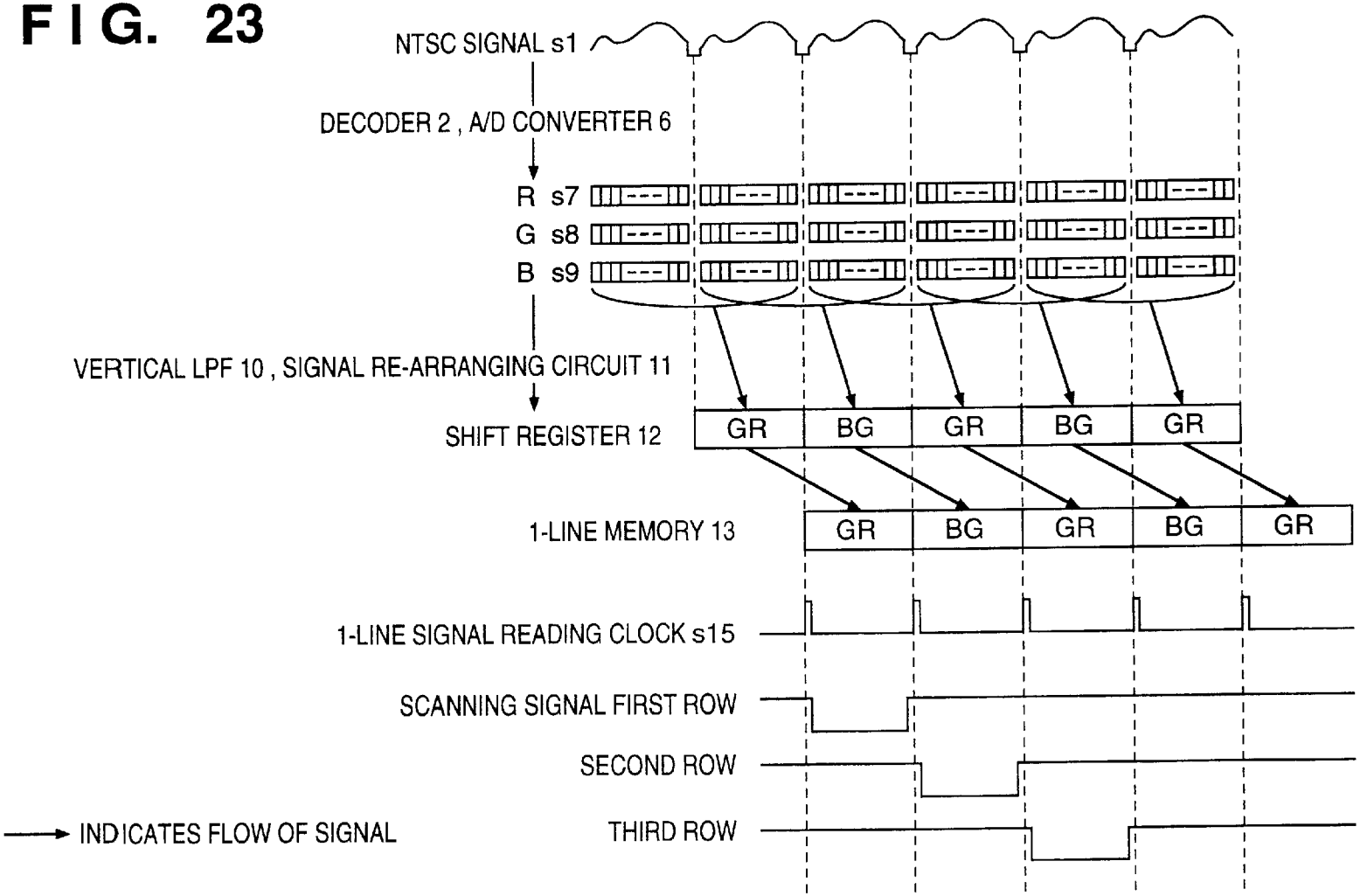
FIG. 23 is a timing chart of the third display method.

However, the present invention is not limited to this specific display method. For example, even in the first to third display methods already described in the columns of the prior arts, the multi-electron beam source as shown in FIG. 1 can be used to easily realize alternate output of R/B and G signals in units of scanning times by a signal re-arranging circuit (corresponding to 11 in FIG. 21) including the signal selection switch 13 (FIG. 2) and the timing control circuit 28 for controlling the switch, and setting of the scanning time ratio to be, e.g., 1:2.

Figure 5:
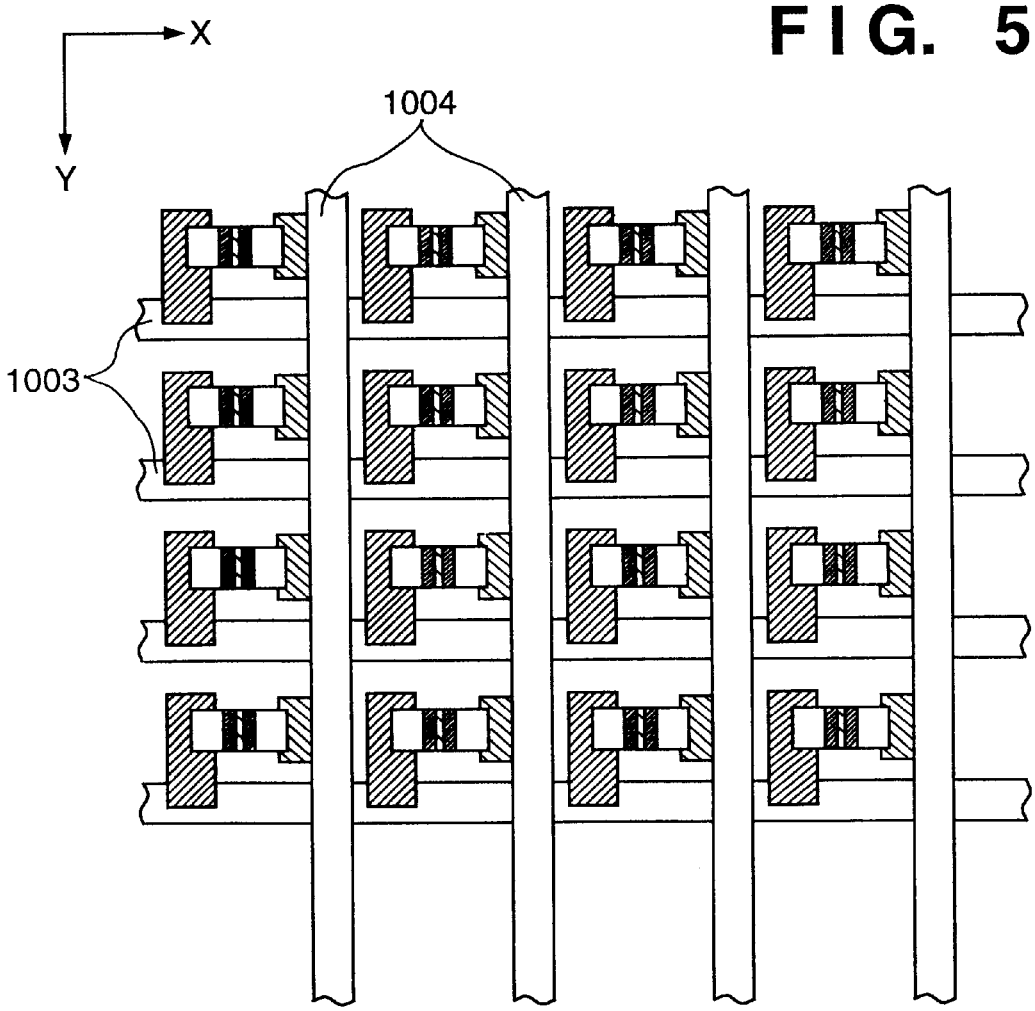
FIG. 5 is a plan view of a substrate of a multi-electron beam source of a comparative example.
Figure 6:
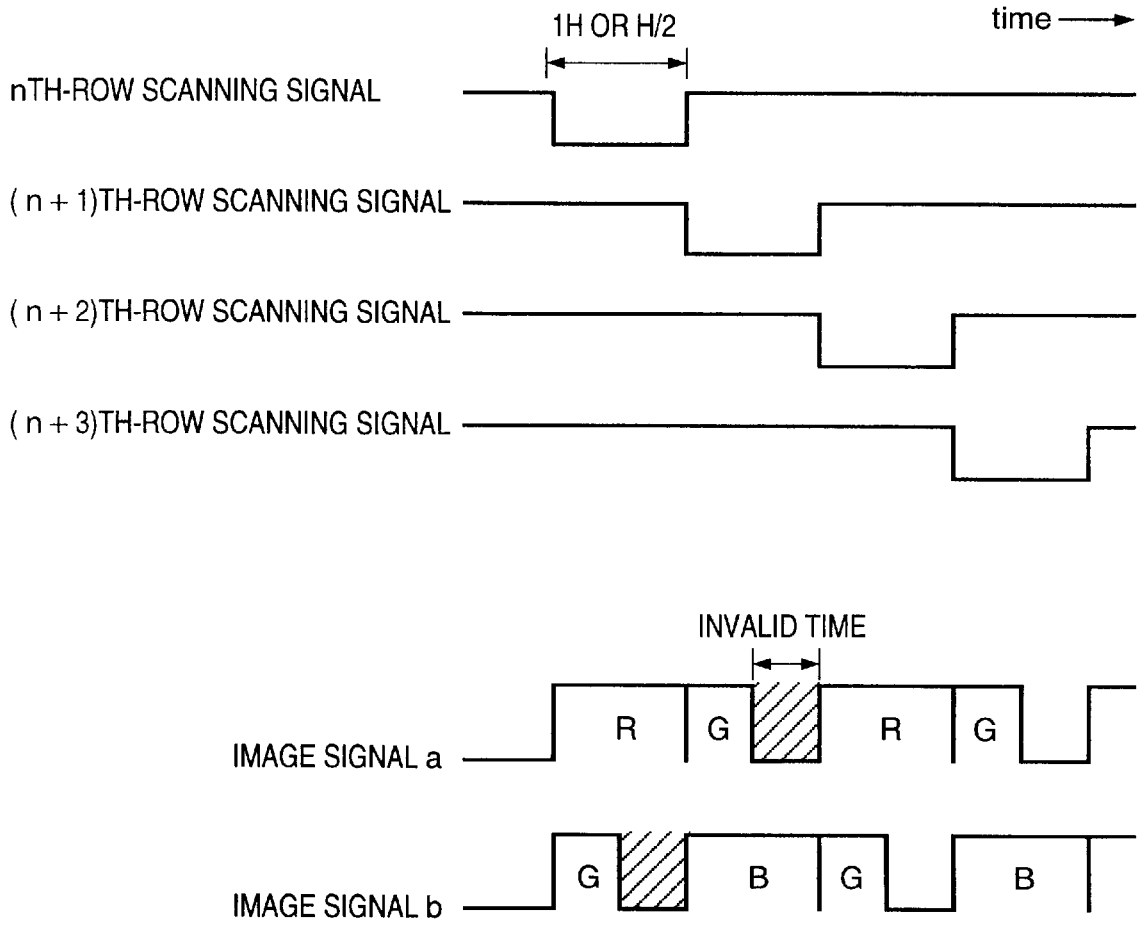
FIG. 6 is a timing chart showing the timings of scanning signals and image signals in the comparative example.

In order to explain the present invention more clearly, FIG. 5 is a plan view showing an example of the conventional multi-electron beam source, and FIG. 6 is a timing chart showing the timings of conventional scanning signals and conventional image signals in FIG. 5. Note that FIG. 6 exemplifies a case wherein gradation expression of image signals is attained by amplitude modulation for the purpose of comparison with this embodiment.

As shown in FIG. 6, in the conventional method, natural white color emission is obtained at the cost of the luminance of G (generation of an invalid period) since the number of G picture elements is larger than the number of R/B picture elements. On the contrary, in this embodiment, generation of such invalid period can be suppressed, as can be seen from FIG. 4. In practice, the display panel obtained by this embodiment can improve white luminance by about 8% as compared to a case wherein the invalid period is generated.

(Structure and Fabrication Method of Display Panel)

The structure and fabrication method of the display panel of the image display apparatus to which the present invention will be described below while presenting examples.

Figure 7:
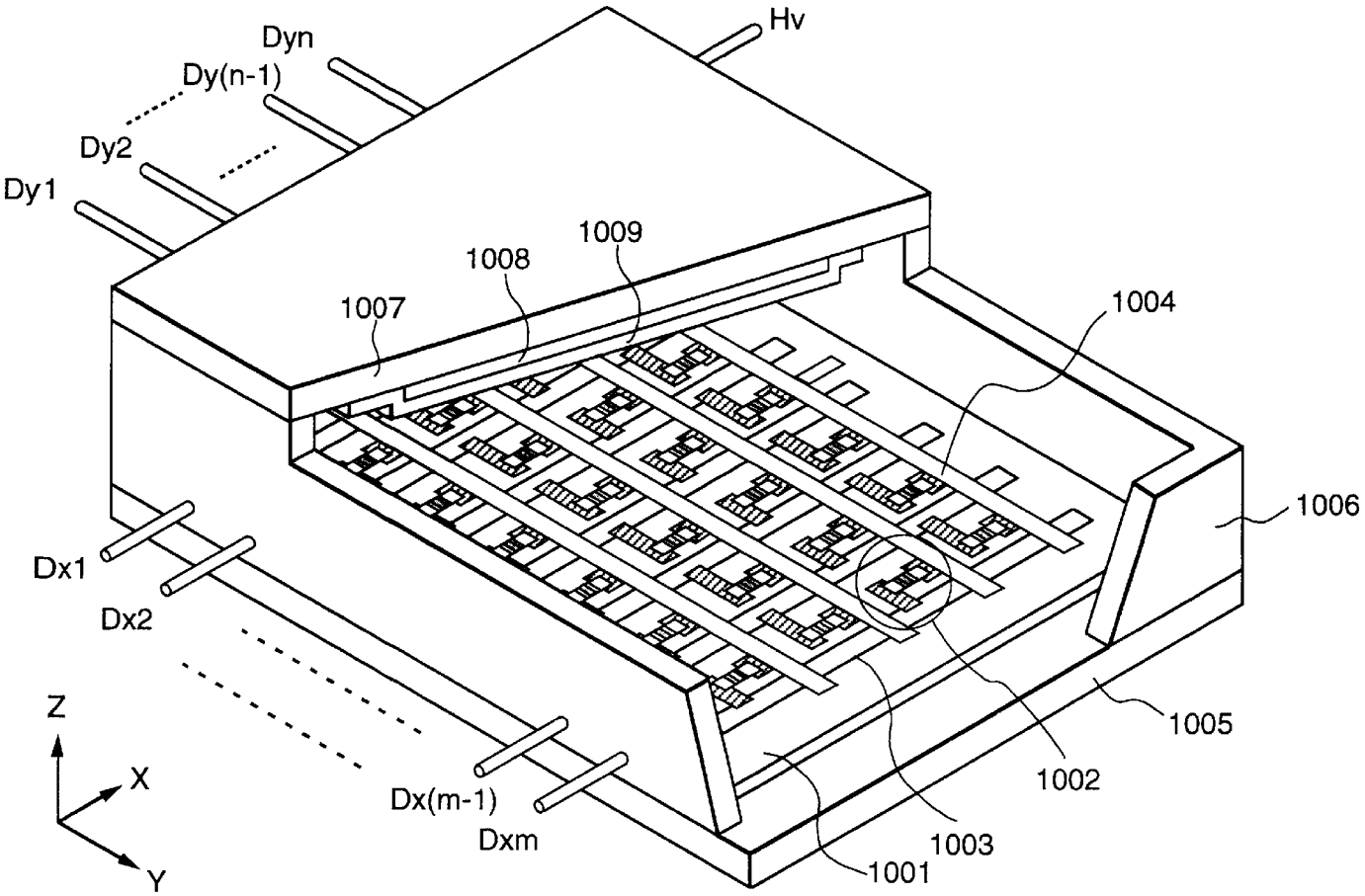
FIG. 7 is a partially cutaway perspective view of a display panel of an image display apparatus according to the embodiment of the present invention.

FIG. 7 is a perspective view of the display panel used in this embodiment, and shows a partially cutaway panel to depict its internal structure.

Referring to FIG. 7, reference numeral 1005 denotes a rear plate; 1006, a side wall; and 1007, a faceplate. These members 1005 to 1007 form an air-tight chamber which maintains the interior of the display panel in a vacuum state. Upon assembling the air-tight chamber, sealed bonding must be done so that the joint points of the respective members hold sufficiently high mechanical strength and air-tight seal. For example, sealed bonding is attained by, e.g., applying frit glass onto each joint portion and sintering the frit glass in air or a nitrogen atmosphere at 400 to 500° C. for 10 minutes or more. The method of evacuating the interior of the air-tight chamber will be described later.

A substrate 1001 is fixed to the rear plate 1005. N×M cold cathode elements 1002 are formed on the substrate 1001 (N and M are positive integers equal to or larger than 2 and are appropriately set in correspondence with the target number of display pixels; for example, in a display apparatus for the purpose of attaining display quality as high as that of a high-definition television system, N≧3,000 and M≧1,000 are desirably set; in this embodiment, N=480 and M=240). The N×M cold cathode elements are connected in a simple matrix pattern by M row electrodes 1003 and N column electrodes 1004.

In this embodiment, the substrate 1001 of the multi-electron beam source is fixed to the rear plate 1005 of the air-tight chamber. If the substrate 1001 of the multi-electron beam source has sufficiently high mechanical strength, the substrate 1001 itself of the multi-electron beam source may be used as the rear plate of the air-tight chamber.

Figure 8:
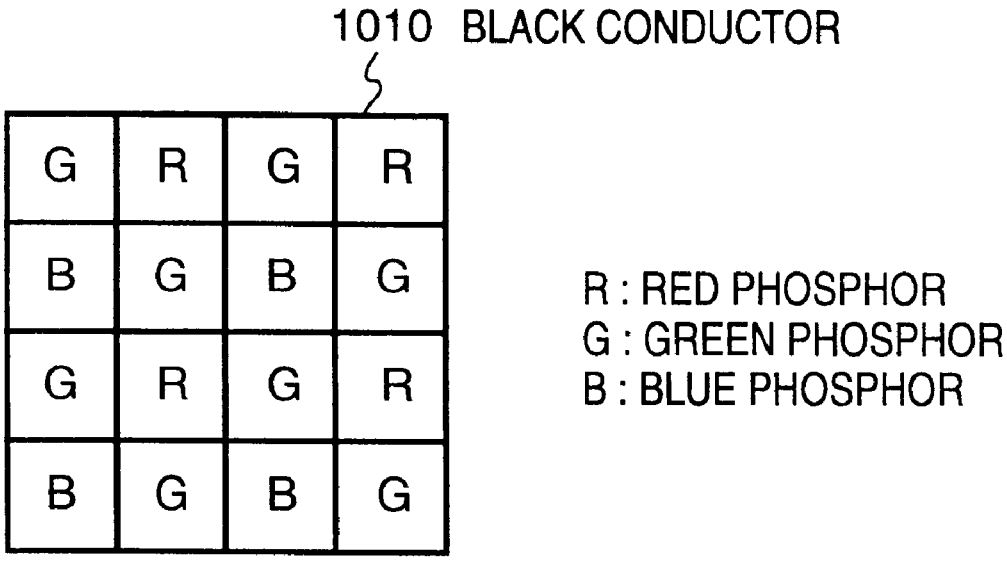
FIG. 8 is a plan view showing an example of the phosphor layout on a faceplate of the display panel.

A fluorescent film 1008 is formed on the lower surface of the faceplate 1007. Since this embodiment exemplifies a color display apparatus, red, green, and blue, three primary color phosphors used in the field of a CRT are selectively painted on the portion of the fluorescent film 1008. These color phosphors are selectively painted in a checkerboard pattern, as shown in, e.g., FIG. 8, and a black conductor pattern 1010 is formed between adjacent phosphors. The black conductor pattern 1010 is formed to prevent misregistration of display colors even when the irradiation positions of electron beams are offset more or less, to prevent a decrease in display contrast by preventing reflection of external light, to prevent charge-up of the fluorescent film by electron beams, and so on. The black conductor pattern 1010 mainly consists of graphite, but any other materials may be used as long as the above-mentioned objectives can be attained.

A metal back 1009, which is the state-of-art one in the field of CRTs, is arranged on the surface, on the rear plate side, of the fluorescent film 1008. The metal back 1009 is arranged to improve light use efficiency by mirror-reflecting some light components of light emitted by the fluorescent film 1008, to protect the fluorescent film 1008 from collision of anions, to use the metal back 1009 as an electrode for applying an electron beam acceleration voltage of, e.g., 10 kV, to use the fluorescent film 1008 as a conduction path of excited electrons, and so on. The metal back 1009 is formed in such a manner that the fluorescent film 1008 is formed on the faceplate 1007, the surface of the fluorescent film is subjected to a smoothing treatment, and an Al film is formed by vacuum deposition on the smoothed surface. Note that the metal back 1009 is not used when the fluorescent film 1008 uses a low-voltage phosphor material.

Although not used in this embodiment, for example, an ITO transparent electrode may be formed between the faceplate 1007 and the fluorescent film 1008 for the purpose of applying an acceleration voltage and improving the conductivity of the fluorescent film.

Reference numerals $Dx_1$ to $Dx_m$, $Dy_1$ to $Dy_n$, and Hv denote electrical connection terminals which have an air-tight structure and are arranged to electrically connect the display panel to an electrical circuit (not shown). The terminals $Dx_1$ to $Dx_m$ are electrically connected to the row electrodes 1003 of the multi-electron beam source, the terminals $Dy_1$ to $Dy_n$ to the column electrodes 1004 of the multi-electron beam source, and the terminal Hv to the metal back 1009 on the faceplate.

In order to evacuate the interior of the air-tight chamber, an exhaust pipe (not shown) is connected to a vacuum pump after the air-tight chamber is assembled, and the interior of the air-tight chamber is evacuated to a vacuum of about $10^{-7}$ Torr. Thereafter, the exhaust pipe is sealed. In this case, in order to maintain the vacuum in the air-tight chamber, a getter film (not shown) is formed at a predetermined position in the air-tight chamber immediately before or after sealing. The getter film is a film formed by heating and depositing a getter material mainly consisting of, e.g., Ba by a heater or high-frequency heating. The interior of the air-tight chamber is maintained at a vacuum of $1\times10^{-5}$ to $1\times10^{-7}$ Torr by the adsorption effect of the getter film.

The basic structure and fabrication method of the display panel according to the embodiment of the present invention have been described.

A method of fabricating the multi-electron beam source used in the display panel of this embodiment will be described below. The multi-electron beam source used in the display panel of the present invention is not particularly limited to the material, shape, and fabrication method of cold cathode elements as long as it comprises an electron source on which cold cathode elements are connected in a simple matrix pattern. Therefore, various cold cathode elements such as surface conduction type emission elements, FE type elements, MIM type elements, and the like may be used.

However, in consideration of a situation in which an inexpensive display apparatus with a large display screen is demanded, surface conduction type emission elements of these cold cathode elements are particularly preferable. More specifically, FE type elements require a sophisticated fabrication technique since their electron emission characteristics are determined depending on the relative positions and shapes of the emitter cone and the gate electrode, and such dependence is disadvantageous for attaining a large-area structure or a reduction of fabrication cost. On the other hand, in MIM type elements, the insulating layer and upper electrode are required to be uniform even when their thicknesses are reduced, and such requirement is disadvantageous, again, for attaining a large-area structure or a reduction of fabrication cost. However, since surface conduction type emission elements allows relatively easy fabrication, a large-area structure and a reduction of fabrication cost can be easily attained. The present inventors found that an element, in which an electron emission portion or its peripheral portion is formed of a fine-particle film, among the surface conduction type emission elements has especially high electron emission characteristics, and can be easily fabricated. Therefore, surface conduction type emission elements of this type are most suitably used in a multi-electron beam source of a high-luminance, large-screen image display apparatus. For this reason, the display panel of this embodiment uses surface conduction type emission elements in each of which an electron emission portion or its peripheral portion is formed of a fine-particle film. The basic structure, fabrication method, and characteristics of a preferred surface conduction type emission element will be explained, and thereafter, the structure of the multi-electron beam source on which a large number of elements are connected in a simple matrix pattern will be explained.

(Preferred Element Structure and Fabrication Method of Surface Conduction Type Emission Element)

There are two typical structures, i.e., flat and vertical structures, of the surface conduction type emission element in which an electron emission portion or its peripheral portion is formed of a fine-particle film.

(Flat Surface Conduction Type Emission Element)

Figure 9A:
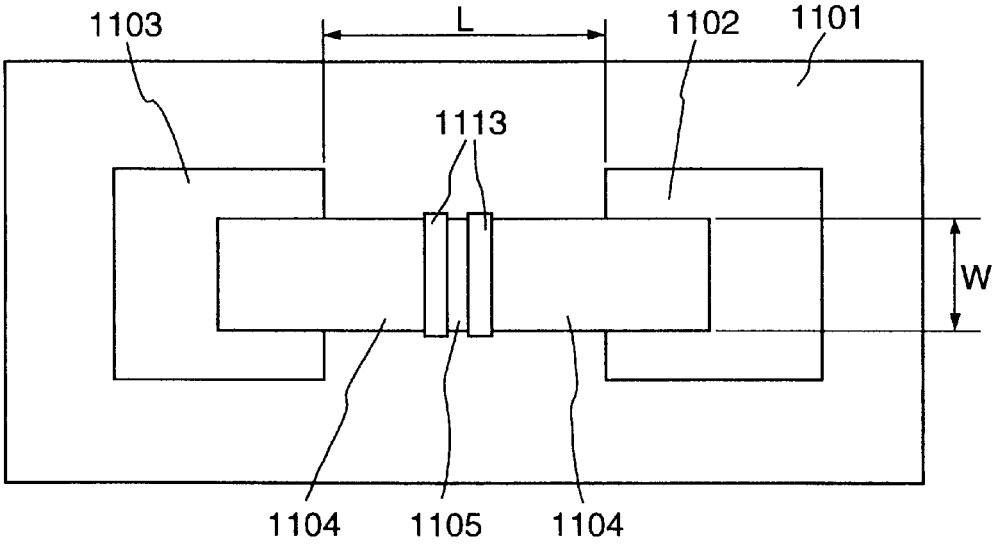
FIGS. 9A and 9B are respectively a plan view and a sectional view of a flat surface conduction type emission element in the plan view used in the embodiment.
Figure 9B:
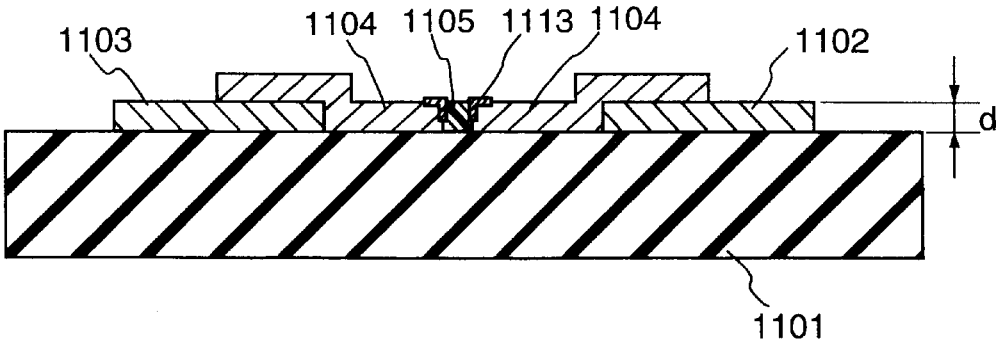

First, the element structure and fabrication method of a flat surface conduction type emission element will be described. FIGS. 9A and 9B are respectively a plan view and a sectional view for explaining the structure of a flat surface conduction type emission element. In FIGS. 9A and 9B, reference numeral 1101 denotes a substrate; 1102 and 1103, element electrodes; 1104; a conductive thin film; 1105, an electron emission portion formed by an energization forming process; and 1113, a thin film formed by an energization activation process.

As the substrate 1101, various kinds of glass substrates such as a quartz glass substrate, a soda-lime glass substrate, and the like, various kinds of ceramics substrates such as an alumina substrate, substrates obtained by stacking an insulating film consisting of, e.g., $SiO_2$ on various kinds of substrates mentioned above, and the like may be used.

The opposing element electrodes 1102 and 1103 formed on the substrate 1101 to be parallel to the substrate surface consist of a material having conductivity. For example, such material can be appropriately selected from metals such as Ni, Cr, Au, Mo, W, Pt, Ti, Cu, Pd, Ag, and the like, alloys of these metals, metal oxides such as $In_2O_3$-$SnO_2$, and the like, semiconductors such as polysilicon, and the like. These electrodes can be easily formed by combining a film formation technique such as vacuum deposition, and a pattern technique such as photolithography, etching, or the like. Alternatively, other methods (e.g., a print technique) may be used.

The shapes of the element electrodes 1102 and 1103 are appropriately selected in correspondence with the application purpose of the electron emission element. In general, the electrode interval, L, is designed by selecting an appropriate value from the range from several hundred Å to several hundred μm, and more preferably from the range from several μm to several ten μm when the element is applied to the display apparatus. Also, as for the thickness, d, of the element electrode, an appropriate value is normally selected from the range from several hundred Å to several hundred μm.

The conductive thin film 1104 is formed using a fine-particle film. Note that the fine-particle film means a film which contains many fine particles (including island-like aggregates) as constituting elements. By microscopically checking the fine-particle film, a structure in which individual fine particles are arranged separately, a structure in which fine particles are arranged adjacent to each other, or a structure in which fine particles overlap each other is normally observed.

The particle sizes of fine particles used in the fine-particle film fall within the range from several Å to several thousand Å, and more preferably, the range from 10 Å to 200 Å. The film thickness of the fine-particle film is appropriately set in consideration of various conditions to be described below: that is, a condition required for electrically and satisfactorily connecting the element electrode 1102 or 1103, a condition required for satisfactorily performing energization forming (to be described later), a condition for setting the electrical resistance of the fine-particle film itself to be an appropriate value (to be described later), and the like. More specifically, the film thickness is set to fall within the range from several Å to several thousand Å, and more preferably, the range from 10 Å to 500 Å.

A material used for forming the fine-particle film is appropriately selected from, e.g., metals such as Pd, Pt, Ru, Ag, Au, Ti, In, Cu, Cr, Fe, Zn, Sn, Ta, W, Pb, and the like, oxides such as PdO, $SnO_2$, $In_2O_3$, PbO, $Sb_2O_3$, and the like, borides such as $HfB_2$, $ZrB_2$, $LaB_6$, $CeB_6$, $YB_4$, $GdB_4$, and the like, carbides TiC, ZrC, HfC, TaC, SiC, WC, and the like, nitrides such as TiN, SrN, HfN, and the like, semiconductors such as Si, Ge, and the like, and carbon, and the like.

As described above, when the conductive thin film 1104 is formed by a fine-particle film, its sheet resistance is set to fall within the range from $10^3$ to $10^7$ Ω/□.

Since it is preferable that the conductive thin film 1104 and the element electrodes 1102 and 1103 be electrically satisfactorily connected, a structure in which the film 1104 and the electrodes 102 and 1103 partially overlap each other is adopted. In an example of FIG. 9B, the substrate, element electrodes, and conductive thin film are stacked upward in this order. Alternatively, the substrate, conductive thin film, and element electrodes may be stacked upward in this order.

The electron emission portion 1105 is a fissure-like portion formed on a portion of the conductive thin film 1104, and electrically has a nature of higher resistance than the surrounding conductive thin film. The fissure is formed by performing an energization forming process (to be described later) for the conductive thin film. In the fissure, fine particles having a particle size of several Å may be arranged in some cases. Since it is hard to precisely and accurately depict the position and shape of an actual electron emission portion, FIGS. 9A and 9B illustrate a typical one.

The thin film 1113 consists of carbon or a carbon compound, and covers the electron emission portion 1105 and its neighboring portion. The thin film 1113 is formed by performing an energization activation process after the energization forming process.

The material of the thin film 1113 is selected from monocrystalline graphite, polycrystalline graphite, amorphous carbon, and mixtures of these materials, and the film thickness of the thin film 1113 is set to be 500 Å or less, and more preferably, 300 Å or less.

Since it is hard to precisely depict the position and shape of an actual thin film 1113, FIGS. 9A and 9B illustrate a typical one. FIG. 9A (plan view) illustrates an element from which the thin film 1113 is partially omitted.

The basic structure of the preferred element has been described. In this embodiment, the following element was used.

More specifically, the substrate 1101 used soda-lime glass, and the element electrodes 1102 and 1103 used an Ni thin film. The thickness d of each element electrode was 1,000 Å, and the electrode interval L was 2 μm.

As the major constituent material of the fine-particle film, Pd or PdO was used, and the fine-particle film had a thickness of about 100 Å and a width W of 100 μm.

The method of fabricating the preferred flat surface conduction type emission element will be described below. FIGS. 10A to 10D are sectional views for explaining the processes in fabricating the surface conduction type emission element, and the same reference numerals in FIGS. 10A to 10D denote the same parts as in FIGS. 9A and 9B.

Figure 10A:
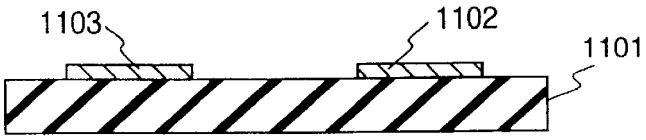
FIGS. 10A to 10E are sectional views showing the processes in fabricating the flat surface conduction type emission element.

1) As shown in FIG. 10A, element electrodes 1102 and 1103 are formed on a substrate 1101.

Upon forming the electrodes, the substrate 1101 is sufficiently washed with a detergent, pure water, and organic solvent, and thereafter, the material of the element electrodes is deposited (as the deposition method, a vacuum film formation technique such as vacuum deposition, sputtering, or the like may be used). Thereafter, the deposited electrode material is patterned using a photolithography etching technique to form a pair of element electrodes (1102 and 1103), as shown in FIG. 10A.

Figure 10B:
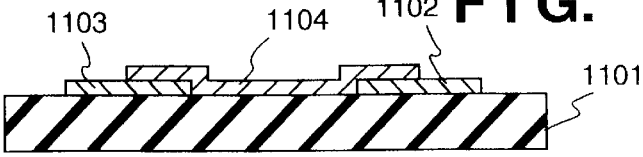

2) As shown in FIG. 10B, a conductive thin film 1104 is formed.

Upon forming the conductive thin film, the substrate in the state in FIG. 10A is coated with an organic metal solvent and is dried. Thereafter, a fine-particle film is formed by sintering the substrate, and thereafter, is patterned into a predetermined shape by photolithography etching. Note that the organic metal solvent is a solvent of an organic metal compound which contains the material of fine particles used in the conductive thin film as a major element. More specifically, this embodiment used Pd as a major element. In this embodiment, dipping is used as the coating method, but other methods such as a spinner method, spray method, and the like may be used.

As the method of forming the conductive thin film consisting of the fine-particle film, for example, vacuum deposition, sputtering, chemical vapor deposition, or the like may be used in place of the method of applying the organic metal solvent used in this embodiment.

Figure 10C:
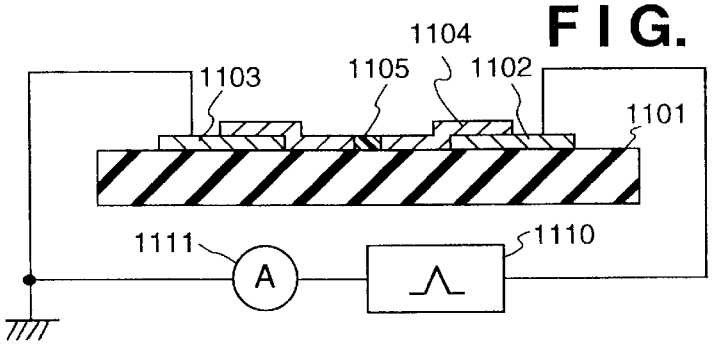

3) As shown in FIG. 10C, an appropriate voltage is applied from a forming power supply 1110 across the element electrodes 1102 and 1103 to perform an energization forming process, thereby forming an electron emission portion 1105.

The energization forming process means a process for energizing the conductive thin film 1104 consisting of the fine-particle film to partially destroy, deform, or denature it and changing its structure to a one suitable for electron emission. Of the conductive thin film consisting of the fine-particle film, in the portion which has changed to have a structure suitable for electron emission (i.e., the electron emission portion 1105), an appropriate fissure is formed in the thin film. By comparing the states before and after the electron emission portion 1105 is formed, the electrical resistance measured between the element electrodes 1102 and 1103 increases greatly after the formation.

Figure 11:
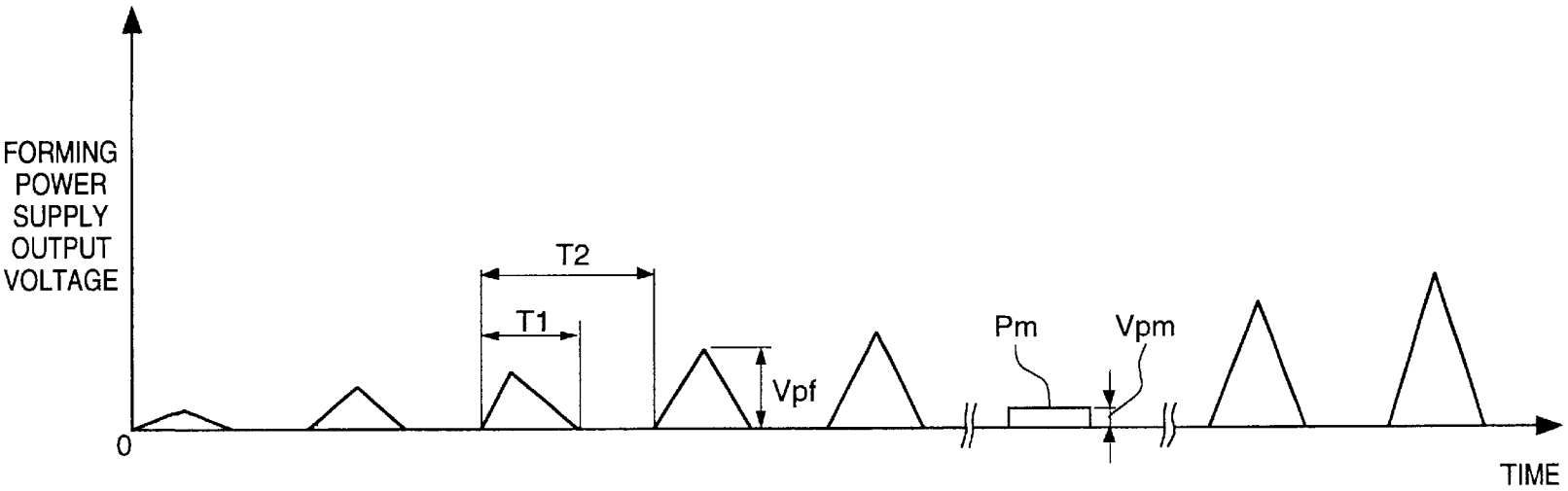
FIG. 11 is a graph showing the voltage waveform applied in an energization forming process.

FIG. 11 shows an example of the appropriate voltage waveform to be applied from the forming power supply 1110 so as to explain the energization method in more detail. When the conductive thin film consisting of the fine-particle film is subjected to forming, a pulse-shaped voltage is preferably used. In this embodiment, as shown in FIG. 11, triangular pulses having a pulse width T1 were successively applied at pulse intervals T2. In this case, the crest value, Vpf, of the triangular pulses was sequentially boosted. Monitor pulses Pm for monitoring the formation state of the electron emission portion 1105 were inserted between adjacent triangular pulses at appropriate intervals, and currents flowed in response to the pulses Pm were measured by an ammeter 1111.

In this embodiment, for example, in a vacuum atmosphere of, e.g., about $10^{-5}$ Torr, the pulse width T1 was set to be 1 msec, the pulse interval T2 was set to be 10 msec, and the crest value Vpf was boosted by 0.1 V per pulse. The monitor pulse Pm was inserted once per five triangular wave pulses. The voltage, Vpm, of each monitor pulse was set to be 0.1 V so as not to adversely influence the forming process. When the electrical resistance between the element electrodes 1102 and 1103 had reached $1\times10^{6}$ Ω, i.e., the currents measured by the ammeter 1111 upon application of the monitor pulse had become $1\times10^{-7}$ Å or less, energization for the forming process was terminated.

Note that the above-mentioned method is a preferred method in association with the surface conduction type emission element of this embodiment. For example, when the design of the surface conduction type emission element such as the material or film thickness of the fine-particle film, the element electrode interval L, or the like, is changed, it is preferable to change the energization conditions in correspondence with such changes in design.

Figure 10D:
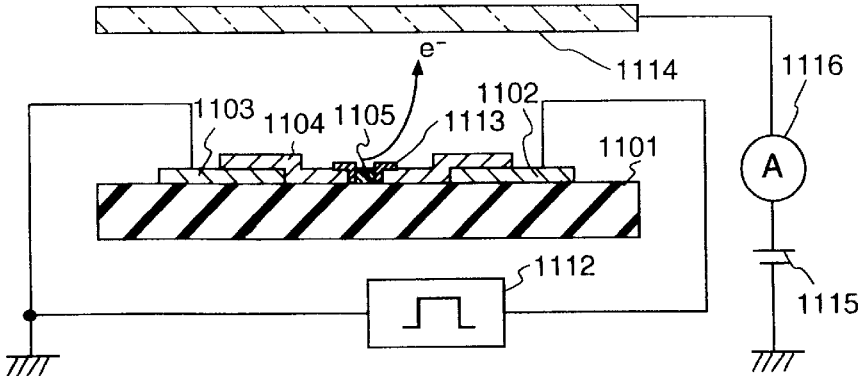

4) As shown in FIG. 10D, an appropriate voltage is applied from an activation power supply 1112 across the element electrodes 1102 and 1103 to perform an energization activation process, thus improving the electron emission characteristics.

The energization activation process is a process for energizing the electron emission portion 1105 formed by the energization forming process under appropriate conditions to stack a carbon or a carbon compound film in the vicinity of the electron emission portion 1105. In FIG. 10D, a deposit consisting of carbon or a carbon compound is illustrated as a member 1113. Upon executing the energization activation process, an emission current obtained by the same applied voltage can be typically increased to 100 times or more that before the process.

More specifically, by periodically applying voltage pulses in a vacuum atmosphere falling within the range from $10^{-4}$ to $10^{-5}$ Torr, a carbon or carbon compound film having an organic compound in the vacuum atmosphere as a source is deposited. The deposit 1113 consists of one of monocrystalline graphite, polycrystalline graphite, and amorphous carbon, or a mixture thereof, and its film thickness is 500 Å or less, and more preferably, 300 Å or less.

Figure 12A:
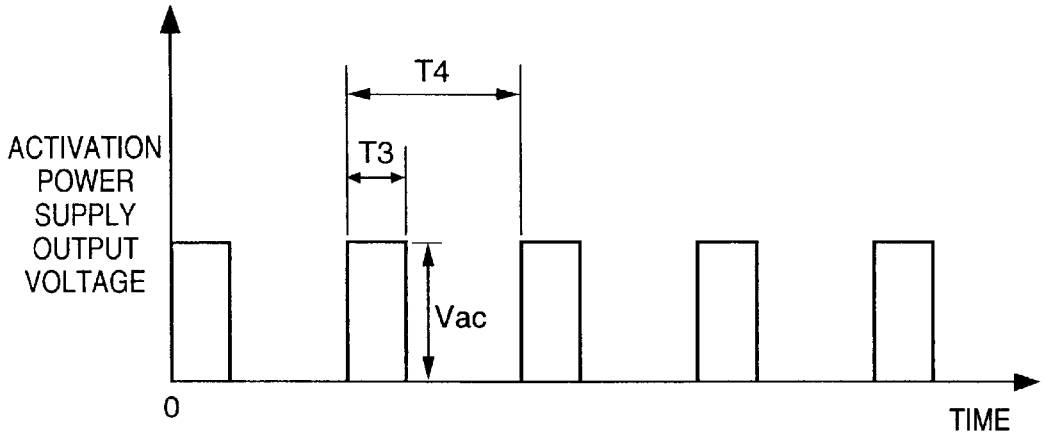
FIGS. 12A and 12B are graphs respectively showing the voltage waveform applied in an energization activation process and changes in emission current Ie.

FIG. 12A shows an example of an appropriate voltage waveform to be applied from the activation power supply 1112 so as to explain the energization method in more detail. In this embodiment, the energization activation process was attained by periodically applying rectangular wave pulses of a constant voltage. More specifically, each rectangular wave pulse had a the voltage Vac of 14 V, a pulse width T3 of 1 msec, and a pulse interval T4 of 10 msec. Note that the above-mentioned energization conditions are preferred ones associated with the surface condition type emission element of this embodiment. When the design of the surface conduction type element is changed, the conditions are preferably changed accordingly.

In FIG. 10D, reference numeral 1114 denotes an anode electrode for compensating for an emission current Ie emitted from the surface conduction type emission element. The anode electrode 1114 is connected to a DC high-voltage power source 1115 and an ammeter 1116. (When the activation process is performed after the substrate 1101 is assembled in the display panel, the fluorescent screen of the display panel is used as the anode electrode 1114.)

Figure 12B:
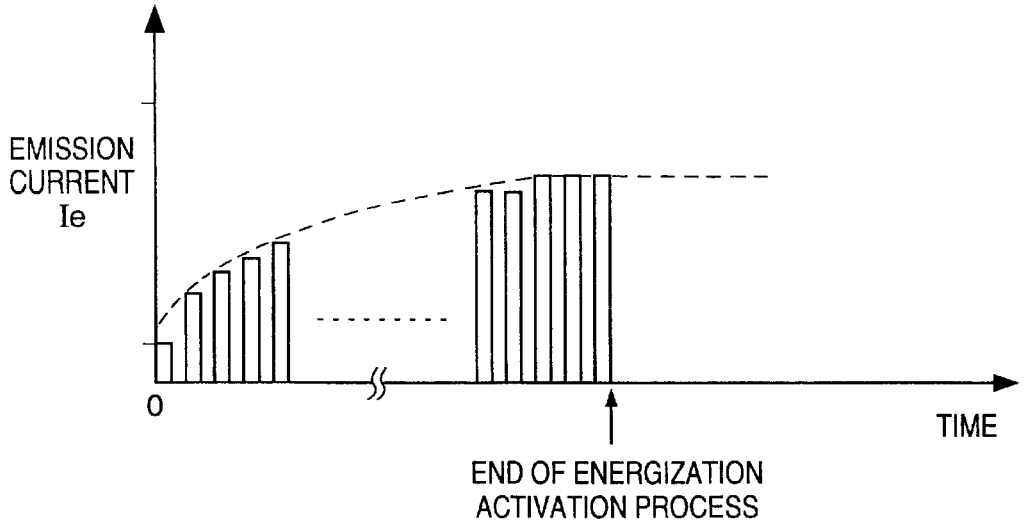

While the voltage is being applied from the activation power supply 1112, the ammeter 1116 measures an emission current Ie to monitor the progress of the energization activation process and to control the operation of the activation power supply 1112. FIG. 12B shows an example of an emission current Ie measured by the ammeter 1116. When the activation power supply 1112 begins to apply voltage pulses, the emission current Ie increases as time elapses, and then reaches saturation and does not increase any more. In this manner, when the emission current Ie has nearly reached saturation, voltage application from the activation power supply 1112 is stopped to end the activation energization process.

Note that the above-mentioned energization conditions are preferred ones associated with the surface condition type emission element of this embodiment. When the design of the surface conduction type element is changed, the conditions are preferably changed accordingly.

Figure 10E:
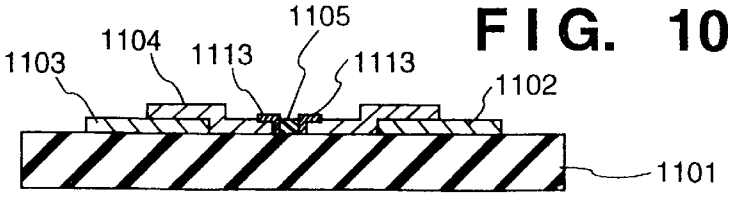

In this way, the flat surface conduction type emission element shown in FIG. 10E was fabricated.

(Step type Surface Conduction Type Emission Element)

Another typical structure of the surface conduction type emission element in which an electron emission element or its peripheral portion is formed using a fine-particle film, i.e., the structure of a step type surface conduction type emission element will be explained below.

Figure 13:
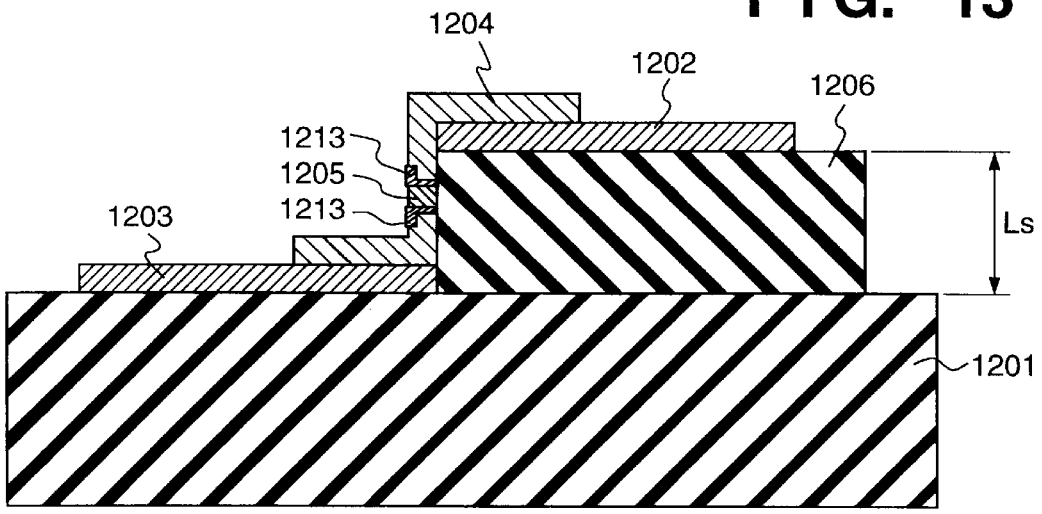
FIG. 13 is a sectional view of a step type surface conduction type emission element used in the embodiment.

FIG. 13 is a sectional view for explaining the basic structure of a step type element. In FIG. 13, reference numeral 1201 denotes a substrate; 1202 and 1203, element electrodes; 1206, a step forming member; 1204, a conductive thin film using a fine-particle film; 1205, an electron emission portion formed by the energization forming process; and 1213, a thin film formed by the energization activation process.

The differences between the step type element and the above-mentioned flat element are that one (1202) of the element electrodes is arranged on the step forming member 1206, and the conductive thin film 1204 covers the side surface of the step forming member 1206. Accordingly, the element electrode interval L in the flat element shown in FIGS. 9A and 9B is designed as a step height Ls of the step forming member 1206 in the vertical element. Note that the substrate 1201, element electrodes 1202 and 1203, and the conductive thin film 1204 using the fine-particle film can use the same materials as listed in the description of the flat element. The step forming member 1206 uses an electrically insulating material such as $SiO_2$.

The method of fabricating the step type surface conduction type emission element will be explained below. FIGS. 14A to 14F are sectional views for explaining the processes in fabricating the emission element, and the same reference numerals in FIGS. 14A to 14F denote the same parts as in FIG. 13.

Figure 14A:
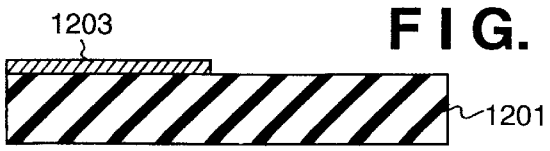
FIGS. 14A to 14F are sectional views showing the processes in the fabrication of the step type surface conduction type emission element.

1) As shown in FIG. 14A, an element electrode 1203 is formed on a substrate 1201.

Figure 14B:
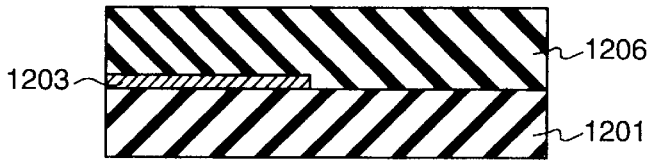

2) As shown in FIG. 14B, an insulating layer used for forming the step forming member is stacked. The insulating layer can be formed by stacking, e.g., an $SiO_2$ film by sputtering but may be formed by other film formation methods such as vacuum deposition, printing, and the like.

Figure 14C:
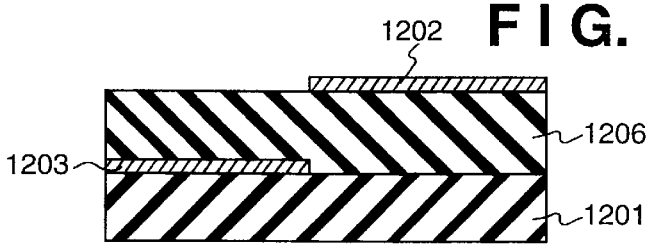

3) As shown in FIG. 14C, an element electrode 1202 is formed on the insulating layer.

Figure 14D:
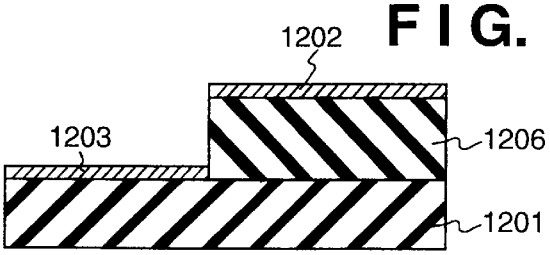

4) As shown in FIG. 14D, a portion of the insulating layer is removed by, e.g., etching to expose the element electrode 1203 therefrom.

Figure 14E:
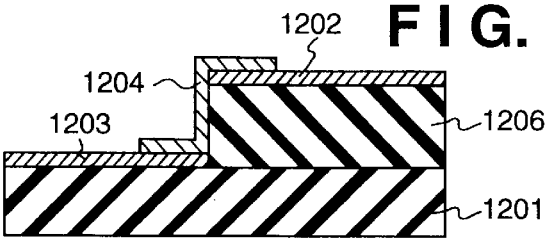

5) As shown in FIG. 14E, a conductive thin film 1204 using a fine-particle film is formed. Upon forming the thin film, for example, a film formation technique such as coating or the like may be used as in the flat element.

6) Subsequently, energization forming is performed as in the flat element to form the electron emission portion. (The same process as the energization forming process for the flat element described above with reference to FIG. 10C can be performed.)

7) An energization activation process is performed as in the flat element to deposit a carbon or a carbon compound film in the vicinity of the electron emission portion. (The same process as the energization activation process for the flat element described above with reference to FIG. 10D can be performed.)

Figure 14F:
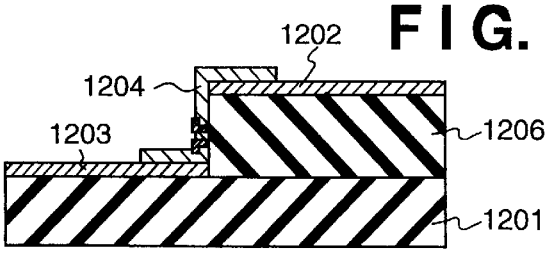

In this manner, the step type surface conduction type emission element shown in FIG. 14F was fabricated.

(Characteristics of Surface Conduction Type Emission Element Used in Display Apparatus)

The element structures and fabrication methods of the flat and step type surface conduction type emission elements have been described. The characteristics of an element used in the display apparatus will be explained below.

Figure 15:
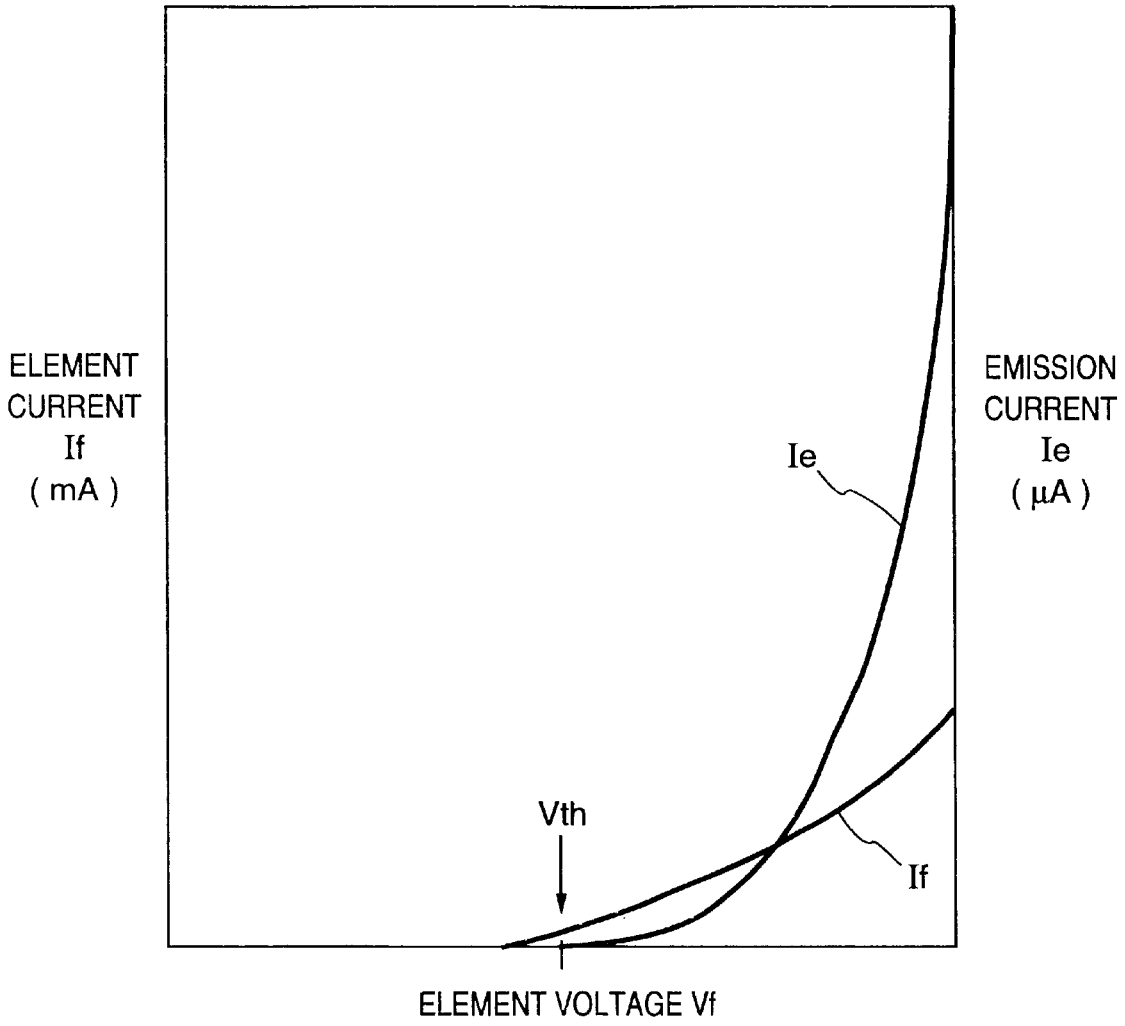
FIG. 15 is a graph showing the typical characteristics of a surface conduction type emission element used in the embodiment.

FIG. 15 shows typical examples of the (emission current Ie) vs. (element applied voltage Vf) characteristics and (element current If) vs. (element applied voltage Vf) characteristics of the element used in the display apparatus. Note that the emission current Ie is considerably weaker than the element current If and it is difficult to express them using an identical measure. Also, these characteristics change upon changing the size of the element or the design parameters. For these reasons, the two graphs are independently expressed in arbitrary units.

The element used in the display apparatus has the following three characteristics with respect to the emission current Ie.

In the first characteristic, when a voltage equal to or higher than a given voltage (this voltage will be referred to as a threshold value voltage Vth thereinafter) is applied to the element, almost no emission current Ie is detected abruptly.

More specifically, the element is a nonlinear element having a definite threshold value voltage Vth with respect to the emission current Ie.

In the second characteristic, since the emission current Ie changes depending on the voltage Vf applied to the element, the magnitude of the emission current Ie can be controlled by the voltage Vf.

In the third characteristic, since the current Ie is emitted by the element at high speed in response to the voltage Vf applied to the element, the charge amount of electrons emitted by the element can be controlled by the duration of application of the voltage Vf.

With the above-mentioned characteristics, the surface conduction type emission element could be suitably used in the display apparatus. For example, when the display apparatus in which a large number of elements are arranged in correspondence with the pixels of an image to be displayed uses the first characteristic, display can be attained by sequentially scanning the display screen. More specifically, a voltage exceeding the threshold value voltage Vth is appropriately applied to the elements to be driven, and a voltage less than the threshold value voltage Vth is applied to the elements in the non-selected state. By sequentially switching the elements to be driven, display can be attained by sequentially scanning the display screen.

Since the emission luminance can be controlled using the second or third characteristic, gradation display can be attained.

(Structure of Multi-Electron Beam Source With a Large Number of Elements Connected in Simple Matrix Pattern)

When the above-mentioned surface conduction type emission elements are arranged on a substrate and are connected in a simple matrix pattern, the multi-electron beam source shown in the plan view of FIG. 1 is obtained.

Figure 16:
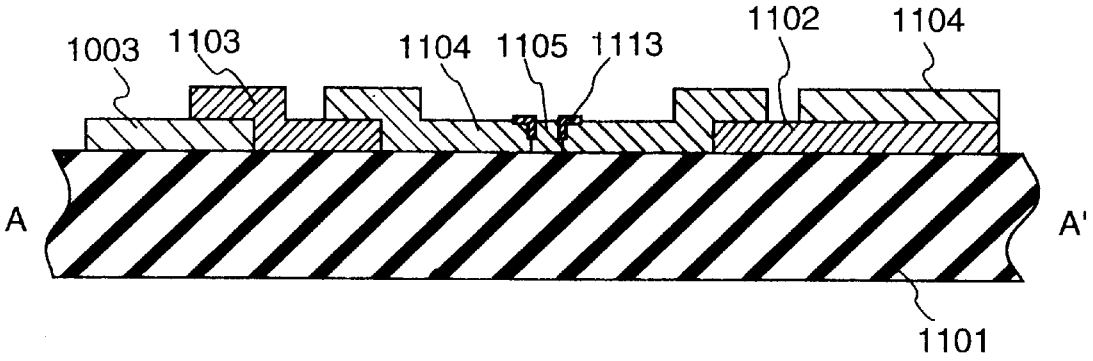
FIG. 16 is a partial sectional view of a substrate of a multi-electron beam source used in the embodiment.

FIG. 16 is a sectional view taken along a line A-A' in FIG. 1.

Note that the multi-electron beam source with such structure was fabricated in such a manner that the row electrodes 1003, column electrodes 1004, inter-electrode insulating layers (not shown), and the element electrodes and conductive thin films of the surface conduction type emission elements were formed in advance on the substrate, and the energization forming process and the energization activation process were performed by supplying voltages to the elements via the row and column electrodes 1003 and 1004.

(Application to Image Display Apparatus)

FIG. 17 is a view showing an example of a display apparatus which is designed so that image information provided from various kinds of image information sources such as a television broadcast can be displayed on the above-mentioned display panel. In FIG. 17, reference numeral 2100 denotes a display panel; 2101, a driving circuit for the display panel; 2102, a display controller; 2103, a multiplexer; 2104, a decoder; 2105, an input/output interface circuit; 2106, a CPU; 2107, an image generation circuit; 2108, 2109, and 2110, image memory interface circuits; 2111, an image input interface circuit; 2112 and 2113, TV signal reception circuits; and 2114, an input unit.

(Note that processing circuits, a loudspeaker, and the like for audio components of input signals such as television signals are not shown in FIG. 17.)

The functions of the respective units will be described below along the flow of an image signal.

The TV signal reception circuit 2113 is a circuit for receiving, e.g., a TV image signal transmitted using a radio transmission system such as radio waves, spatial optical communications, or the like. The type of TV signal to be received is not particularly limited, and for example, NTSC signals, PAL signals, SECAM signals, MPEG signals, and the like may be received. Also, a TV signal consisting of a larger number of scanning lines (e.g., a so-called high-definition TV such as a MUSE system) is a preferred signal source that can enjoy the advantages of the above-mentioned display panel which is suitable for a large-area, multi-pixel structure. A TV signal received by the TV signal reception circuit 2113 is output to the decoder 2104.

On the other hand, the TV signal reception circuit 2112 is a circuit for receiving a TV image signal transmitted via a wired transmission system such as a coaxial cable, optical fiber, or the like. As in the TV signal reception circuit 2113, the type of TV signal to be received is not particularly limited, and a TV signal received by this circuit is also output to the decoder 2104.

The image input interface circuit 2111 is a circuit for inputting an image signal supplied from an image input apparatus such as a TV camera, an image scanner, or the like, and the input image signal is output to the decoder 2104.

The image memory interface circuit 2110 is a circuit for inputting an image signal recorded on a video tape recorder (to be abbreviated as a VTR hereinafter), and the input image signal is output to the decoder 2104.

The image memory interface circuit 2109 is a circuit for inputting an image signal recorded on a video disk, and the input image signal is output to the decoder 2104.

The image memory interface circuit 2108 is a circuit for inputting an image signal from a device that records still image data such as a so-called still image disk, and the input image signal is output to the decoder 2104.

The input/output interface circuit 2105 is a circuit for connecting this display apparatus and an external computer, computer network, or an output apparatus such as a printer. The circuit 2105 can input/output not only image data and character/figure information, but also control signals and numerical value data between the CPU 2106 of this display apparatus and the external apparatus in some cases.

The image generation circuit 2107 is a circuit for generating display image data on the basis of image data or character/figure information input from the external apparatus via the input/output interface circuit 2105 or image data or character/figure information output from the CPU 2106. This circuit includes circuits required for generating an image such as a rewritable memory for storing image data and character/figure information, a read-only memory storing image patterns corresponding to character codes, a processor for performing image processing, and the like.

The display image data generated by this circuit is output to the decoder 2104. In some cases, the display image data can also be output to the external computer network or printer via the input/output interface circuit 2105.

The CPU 2106 mainly performs the operation control of this display apparatus, and executes jobs associated with generating, selecting, and editing a display image.

For example, the CPU 2106 outputs a control signal to the multiplexer 2103 to appropriately select or combine image signals to be displayed on the display panel. In this case, the CPU 2106 generates a control signal to the display panel controller 2102 in correspondence with the image signal to be displayed so as to appropriately control the operation of the display apparatus such as the screen display frequency, scanning method (e.g., interlace or non-interlace), the number of scanning lines per frame, and the like.

Furthermore, the CPU 2106 directly outputs image data or character/figure information to the image generation circuit 2107, or accesses the external computer or memory via the input/output interface circuit 2105 to input image data or character/figure information thereto.

Note that the CPU 2106 may perform jobs other than those described above. For example, the CPU 2106 may directly execute a function for generating or processing information like in a personal computer or wordprocessor.

Alternatively, the CPU 2106 may be connected to the external computer network via the input/output interface circuit 2105, as described above, so as to execute jobs such as arithmetic operations in cooperation with the external apparatus.

The input unit 2114 is used by a user to input commands, programs, or data to the CPU 2106. For example, as the input unit 2114, various input devices such as a keyboard, mouse, joystick, bar code reader, speech recognition device, and the like may be used.

The decoder 2104 is a circuit for inversely converting various types of image signals input from the circuits 2107 to 2113 into three primary color signals or a luminance signal, and I and Q signals. As indicated by a dotted line in FIG. 17, the decoder 2104 preferably comprises an internal image memory. This is to process TV signals such as TV signals of the MUSE system that require an image memory upon inverse conversion. When the decoder 2104 comprises an image memory, the following merits can also be provided. That is, a still image can be easily displayed, and image processing and edit processing such as thinning, interpolation, enlargement, synthesis, and the like of images can be easily attained in combination with the image generation circuit 2107 and the CPU 2106.

The multiplexer 2103 appropriately selects a display image on the basis of the control signal input from the CPU 2106. More specifically, the multiplexer 2103 selects a desired one of inversely converted image signals input from the decoder 2104 and outputs the selected signal to the driving circuit 2101. In this case, when the multiplexer 2103 selects an image signal while switching signals within one screen display time, different images can be displayed on a plurality of regions obtained by dividing one screen like in a so-called multi-screen television.

The display panel controller 2102 is a circuit for controlling the operation of the driving circuit 2101 on the basis of the control signal input from the CPU 2106.

Also, the display panel controller 2102 outputs a signal for controlling the operation sequence of a driving power supply (not shown) of the display panel to the driving circuit 2101 as a signal associated with the basis operation of the display panel.

Furthermore, the display panel controller 2102 outputs a signal for controlling the screen display frequency or scanning method (e.g., interlace or non-interlace) to the driving circuit 2101 as a signal associated with the driving method of the display panel.

In some cases, the display panel controller 2102 outputs a control signal associated with adjustment of image quality such as luminance, contrast, color tone, sharpness, and the like of a display image to the driving circuit 2101.

The driving circuit 2101 is a circuit for generating a driving signal to be applied to the display panel 2100, and operates on the basis of the image signal input from the multiplexer 2103 and the control signal input from the display panel controller 2102.

The functions of the respective units have been described. With the arrangement shown in FIG. 17, the display apparatus of this embodiment can display image information input from various kinds of image information sources on the display panel 2100. More specifically, various kinds of image signals such as a television broadcast signal are inversely converted by the decoder 2104, the converted signals are appropriately selected by the multiplexer 2103, and the selected signal is input to the driving circuit 2101. On the other hand, the display panel controller 2102 generates a control signal for controlling the operation of the driving circuit 2101 in accordance with the image signal to be displayed. The driving circuit 2101 applies a driving signal to the display panel 2100 on the basis of the image signal and the control signal. With this processing, an image is displayed on the display panel 2100. The series of operations described above are systematically controlled by the CPU 2106.

In this display apparatus, using the internal image memory of the decoder 2104, the image generation circuit 2107, and the CPU 2106, not only a selected one of a plurality of kinds of image information is selected but also image processing such as enlargement, reduction, rotation, movement, edge emphasis, thinning, interpolation, color conversion, aspect ratio conversion, and the like of images and image edit processing such as synthesis, deletion, merge, replacement, paste, and the like can be performed for the image information to be displayed. Although not particularly pointed out in the description of this embodiment, dedicated circuits for processing and editing audio information may be arranged as in the image processing and image edit processing.

Therefore, the display apparatus of this embodiment alone can provide functions of a television broadcast display apparatus, a television meeting terminal apparatus, an image edit apparatus, a computer terminal apparatus, office terminal apparatuses such as a word processor, a game machine, and the like, and has a very broad application range of industrial or domestic apparatuses. In addition, since a low-profile display panel can be realized, the depth of the apparatus can be decreased. In addition, as the display apparatus of this embodiment can easily attain a large screen, high luminance, and high field angle characteristics, it can display a real image with high recognizability.

Note that the present invention may be applied to either a system constituted by a plurality of devices or an apparatus consisting of a single device. Also, the present invention can also be applied to a case wherein the invention is attained by supplying a program to the system or apparatus.

The above-mentioned display apparatus uses the surface conduction type emission elements which allow easy fabrication as electron emission elements but may use other types of electron emission elements to achieve the present invention.

Figure 18A:
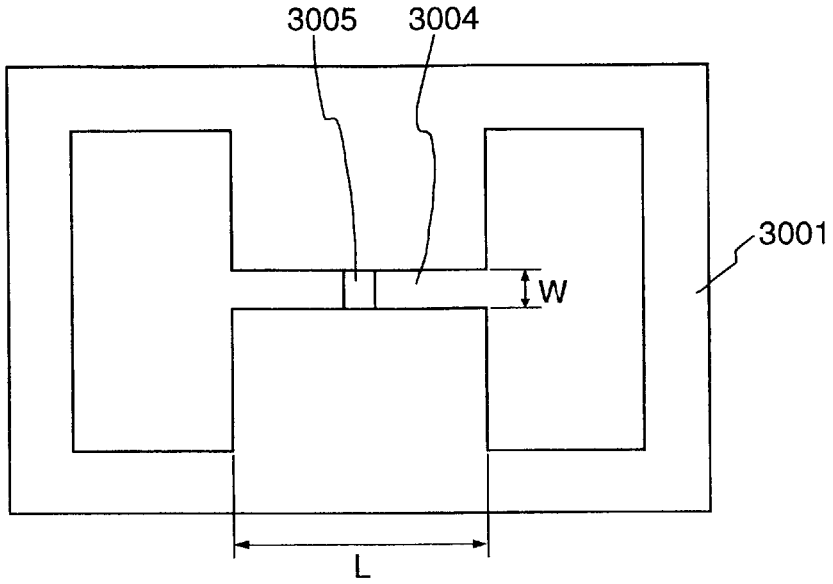
FIGS. 18A and 18B are views respectively showing the element structures of a conventional surface conduction type emission element and an FE type element.
Figure 18B:
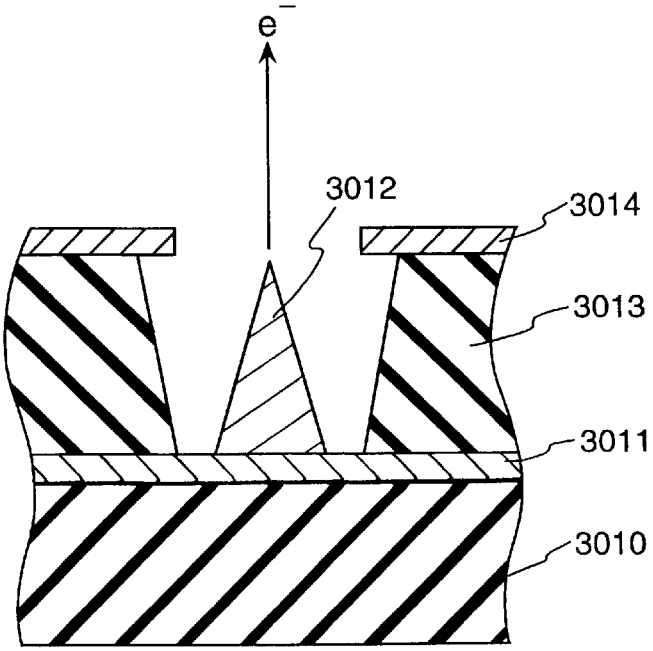
Figure 24:
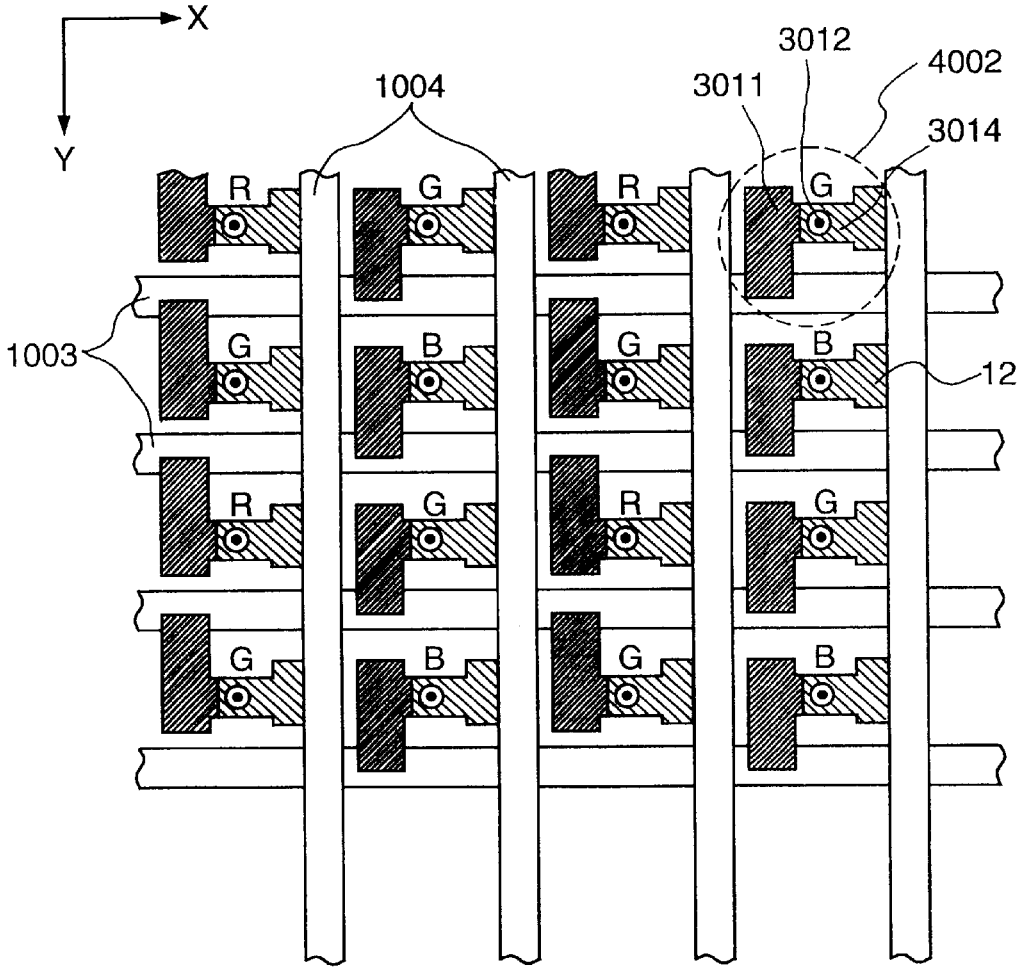
FIG. 24 is a plan view of an electron source substrate of an embodiment using FE type elements.

For example, in a display apparatus using FE type elements in place of surface conduction type emission elements as well, the luminance can be increased while maintaining good color balance. FIG. 24 is a plan view of an electron source using FE type elements. In FIG. 24, reference numeral 4002 denotes one FE type element, and the members 3011, 3012, and 3014 are the same as those described above with reference to FIG. 18B. Note that the insulating layer 3013 is not shown in FIG. 24 since it is not seen behind the gate electrode 3014. A description about the electrodes 1003 and 1004 will be omitted since it is the same as that which has already given above with reference to FIG. 1.

Figure 19:
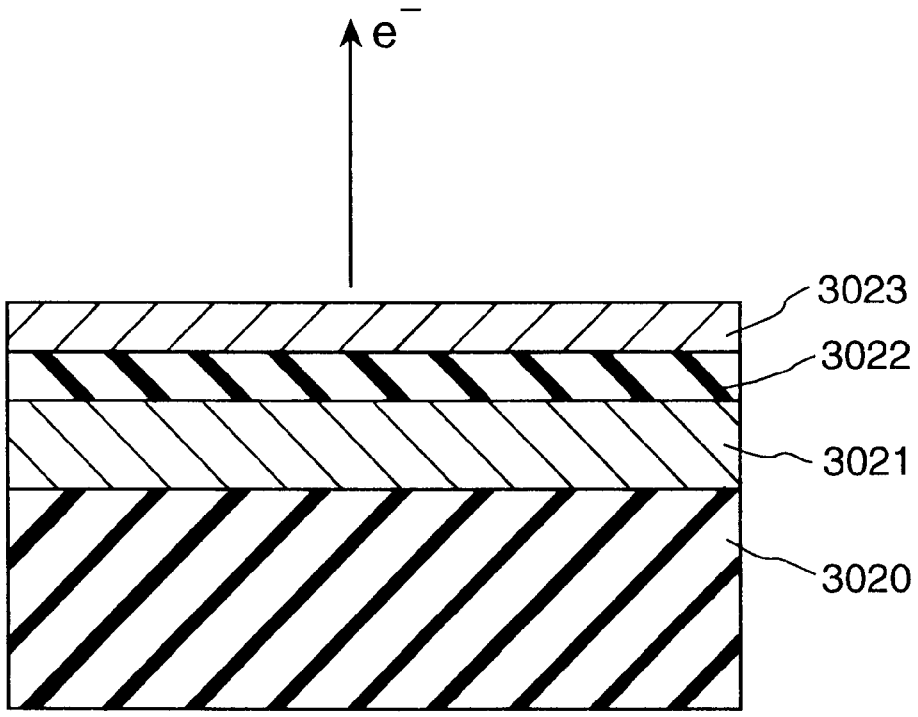
FIG. 19 is a view showing the structure of an MIM type element.
Figure 25:
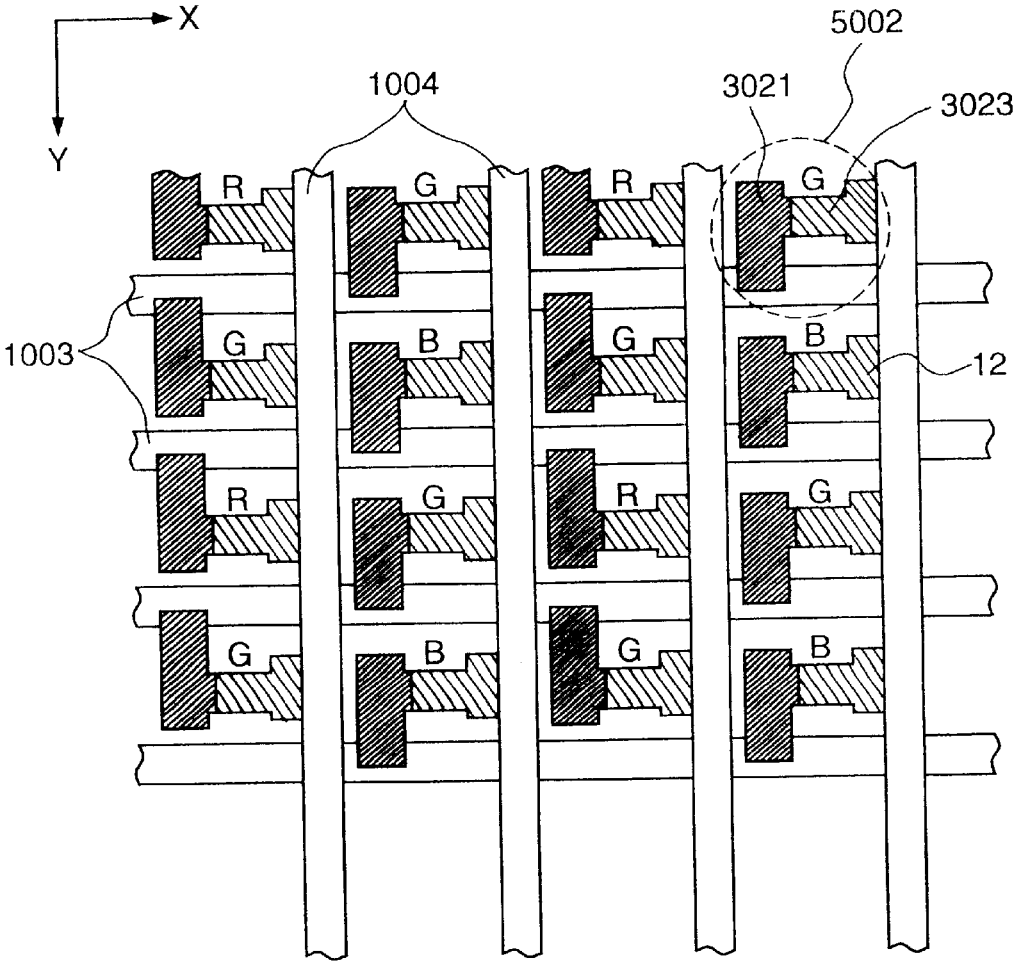
FIG. 25 is a plan view of an electron source substrate of an embodiment using MIM type elements.

Also, in a display apparatus using MIM type elements in place of the surface conduction type emission elements, the luminance can be increased while maintaining good color balance. FIG. 25 is a plan view of an electron source using FE type elements. In FIG. 25, reference numeral 5002 denotes one MIM type element, and the members 3021 and 3023 are the same as those described above with reference to FIG. 19. Note that the insulating layer 3022 is not shown in FIG. 25 since it is not seen behind the upper electrode 3023. A description about the electrodes 1003 and 1004 will be omitted since it is the same as that which has already given above with reference to FIG. 1.

As many apparently widely different embodiments of the present invention can be made without departing from the spirit and scope thereof, it is to be understood that the invention is not limited to the specific embodiments thereof except as defined in the appended claims.

What is claimed is:

1. An image display apparatus which comprises a multi-electron beam source in which a plurality of electron emission elements are connected in a matrix pattern using a plurality of data electrodes and a plurality of scanning electrodes, and a fluorescent screen having phosphors of three primary colors R, G, and B corresponding to said electron emission elements, wherein said fluorescent screen has the G phosphors at a ratio larger than the ratio of the R or B phosphors, and said multi-electron beam source has the scanning electrodes connected to the electron emission elements corresponding to the G phosphors electrically independent from the scanning electrodes connected to the electron emission elements corresponding to the R or B phosphors.

2. The apparatus according to claim 1, wherein the phosphors are arranged in a checkerboard pattern at an area ratio R:G:B=1:2:1.

3. The apparatus according to claim 1 or 2, wherein a period for selecting the scanning electrode connected to the electron emission elements corresponding to the G phosphors is substantially ½ of a period for selecting the scanning electrode connected to the electron emission elements corresponding to the R or B phosphors.

4. The apparatus according to claim 1, wherein signal components corresponding to the G phosphors and signal components corresponding to the R or B phosphors are extracted from an image signal for a 1-line period, and the scanning electrode connected to the electron emission elements corresponding to the G phosphors and the scanning electrode connected to the electron emission elements corresponding to the R or B phosphors are selected successively during the 1-line period.

5. The apparatus according to claim 1, wherein an image signal for a 1-line period is divided into signal components for two rows, the scanning electrodes for two rows are selected successively during a given 1-line period, and a portion of the rows selected during the 1-line period can be selected again during the next 1-line period.

6. The apparatus according to claim 1, wherein said electron emission elements comprise surface conduction type emission elements.

7. The apparatus according to claim 1, wherein said electron emission elements comprise FE type elements.

8. The apparatus according to claim 1, wherein said electron emission elements comprise MIM type elements.

9. A method of driving an image display apparatus which comprises a multi-electron beam source in which a plurality of electron emission elements are connected in a matrix pattern using a plurality of data electrodes and a plurality of scanning electrodes, and a fluorescent screen having phosphors of three primary colors R, G, and B corresponding to said electron emission elements, wherein the G phosphors are arranged at a ratio larger than the ratio of the R or B phosphors, the scanning electrodes connected to the electron emission elements corresponding to the G phosphors are electrically independent from the scanning electrodes connected to the electron emission elements corresponding to the R or B phosphors, and signal components corresponding to the G phosphors and signal components corresponding to the R or B phosphors are extracted from an image signal for a 1-line period, and the scanning electrode connected to the electron emission elements corresponding to the G phosphors and the scanning electrode connected to the electron emission elements corresponding to the R or B phosphors are selected successively during the 1-line period.

10. The method according to claim 9, wherein the phosphors are arranged in a checkerboard pattern at an area ratio R:G:B=1:2:1.

11. The method according to claim 9 or 10, wherein a period for selecting the scanning electrode connected to the electron emission elements corresponding to the G phosphors is substantially ½ of a period for selecting the scanning electrode connected to the electron emission elements corresponding to the R or B phosphors.

12. The method according to claim 9, wherein an image signal for a 1-line period is divided into signal components for two rows, the scanning electrodes for two rows are selected sucessively during a given 1-line period, and a portion of the rows selected during the 1-line period can be selected again during the next 1-line period.

13. The method according to claim 9, wherein said electron emission elements comprise surface conduction type emission elements.

14. The method according to claim 9, wherein said electron emission elements comprise FE type elements.

15. The method according to claim 9, wherein said electron emission elements comprise MIM type elements.

* * * * *

UNITED STATES PATENT AND TRADEMARK OFFICE

CERTIFICATE OF CORRECTION

PATENT NO. : 5,949,393
DATED : September 7, 1999
INVENTOR(S) : Kunihiro Sakai et al.

It is certified that error appears in the above-identified patent and that said Letters Patent is hereby corrected as shown below:

Title Page,
[56] References cited,
Under U.S. PATENT DOCUMENTS:

Insert: --4,642,619 2/1987 Togashi
5,412,395 5/1995 Maeda et al.
5,734,427 5/1995 Hayashi --;

Under FOREIGN PATENT DOCUMENTS:

"1031332" should read -- 1-031332 --;
"2257551" should read -- 2-257551 --;
"3055738" should read -- 3-055738 --;
"4028137" should read -- 4-028137 --;

Under OTHER PUBLICATIONS:

After M. Hartwell, et al.: "Tin-Indinum" should read -- Tin-Indium --; and

Under Attorney, Agent, or Firm:

"Fitzpatrick, Cella, Harper & Scinto" should read -- Fitzpatrick, Cella, Harper & Scinto --.

Column 3:
Line 20, "et al." should read -- et al. --.

UNITED STATES PATENT AND TRADEMARK OFFICE

CERTIFICATE OF CORRECTION

PATENT NO. : 5,949,393
DATED : September 7, 1999
INVENTOR(S) : Kunihiro Sakai et al.

It is certified that error appears in the above-identified patent and that said Letters Patent is hereby corrected as shown below:

Column 5:
Line 64, "complicate" should read -- complicated --.

Column 7:
Line 29, "connected" should read -- connected to --.

Column 12:
Line 55, "tion" should read -- tion pertains --.

Column 24:
Line 12, "given" should read -- been given --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*